US009996032B2

(12) United States Patent
Mizukoshi et al.

(10) Patent No.: US 9,996,032 B2
(45) Date of Patent: Jun. 12, 2018

(54) DEVELOPER CONTAINER, DEVELOPMENT APPARATUS, PROCESS CARTRIDGE, AND IMAGE FORMING APPARATUS

(71) Applicant: CANON KABUSHIKI KAISHA, Tokyo (JP)

(72) Inventors: Shunsuke Mizukoshi, Yokohama (JP); Kazuhisa Shida, Kawasaki (JP); Takayuki Kanazawa, Yokohama (JP); Yuta Isobe, Kawasaki (JP); Makoto Tokudome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/476,633

(22) Filed: Mar. 31, 2017

(65) Prior Publication Data

US 2017/0293243 A1 Oct. 12, 2017

(30) Foreign Application Priority Data

Feb. 13, 2017 (JP) ..... 2017-024417

(51) Int. Cl.
*G03G 15/08* (2006.01)
*G03G 21/18* (2006.01)

(52) U.S. Cl.
CPC ..... *G03G 15/0891* (2013.01); *G03G 15/0865* (2013.01); *G03G 21/1814* (2013.01); *G03G 2215/0687* (2013.01); *G03G 2215/088* (2013.01); *G03G 2215/0825* (2013.01); *G03G 2215/0875* (2013.01); *G03G 2215/0877* (2013.01)

(58) Field of Classification Search
CPC ..... G03G 15/0865; G03G 15/0891; G03G 21/1814; G03G 2215/0687; G03G 2215/0825; G03G 2215/0875; G03G 2215/0877; G03G 2215/088
See application file for complete search history.

(56) References Cited

U.S. PATENT DOCUMENTS 5,749,026 A * 5/1998 Goldie ..... G03G 21/181 399/103
6,058,278 A * 5/2000 Tsuda ..... G03G 21/1832 399/106
6,671,481 B1 * 12/2003 Terry ..... G03G 15/0875 399/258
2010/0158562 A1 * 6/2010 Kwon ..... G03G 15/0896 399/111
2013/0034368 A1 * 2/2013 Hattori ..... G03G 15/0881 399/106

(Continued)

*Primary Examiner* — Ryan Walsh
(74) *Attorney, Agent, or Firm* — Canon U.S.A., Inc. IP Division

(57) ABSTRACT

The disclosed structure includes a belt-shaped conveying member configured to convey developer. The conveying member includes a partitioning portion, which is a partition for developer contained in a casing with respect to a conveying direction in which the developer is conveyed, wherein, when the developer container is new, a first developer amount which is an amount of the developer contained at an upstream side that is upstream of the partitioning portion in the conveying direction, is larger than a second developer amount which is an amount of the developer contained at a downstream side that is downstream of the partitioning portion in the conveying direction.

13 Claims, 17 Drawing Sheets

(56) References Cited

U.S. PATENT DOCUMENTS

2014/0169827 A1* 6/2014 Hattori ..... G03G 15/0882
399/106
2014/0341610 A1 11/2014 Jang et al.

* cited by examiner

DEVELOPER CONTAINER, DEVELOPMENT APPARATUS, PROCESS CARTRIDGE, AND IMAGE FORMING APPARATUS

BACKGROUND OF THE INVENTION

Field of the Invention

Embodiments of the present disclosure generally relate to an image forming apparatus configured to form an image on a recording medium, for example, an electrophotographic printer, an electrophotographic copier, and the like, and further relate to a developer container, a development apparatus, and a process cartridge for use in such an image forming apparatus.

In the description below, the term "image forming apparatus" means an apparatus configured to form an image on a recording medium. The term "process cartridge" means a device that includes at least an image bearing member. In many cases, a process cartridge is an integrated device that includes an electric charger, a development device, a cleaner, and an image bearing member, with all of them integrated in the form of a cartridge, and is configured to be able to be attached to the body of an image forming apparatus as a detachable cartridge. The term "development apparatus" means a device that includes at least a developer bearing member. In many cases, a development apparatus is an integrated device that includes a developer bearing member, a development casing that supports the developer bearing member, and relevant parts, with all of them integrated. In addition, the integrated device is configured to be able to be attached to the body of an image forming apparatus detachably. The term "developer container" means a container that contains developer.

Description of the Related Art

In related art, electrostatic recording and electrophotographic recording are widely used in image forming apparatuses such as copiers and printers. A related example of them is a development apparatus disclosed in U.S. Patent Application Laid-Open No. 2014-0341610. The apparatus disclosed in said U.S. publication is provided with a belt-shaped conveying member. The flexible sheet material of the conveying member is formed into a belt shape and is supported by shafts.

In order to ensure stable image forming operation, various parts are arranged in a complex layout inside a development section. In a related development apparatus, for the purpose of preventing the leakage of a toner through a gap between these plural parts, a leakage prevention member is provided for closing the gap.

However, if a large amount of toner is present in a development section when a development apparatus is exposed to strong vibration, for example, during transportation, the leakage of not a small amount of toner sometimes occurs even with the use of a leakage prevention member mentioned above.

Some models are provided with a toner sealer to address this technical issue. A toner sealer is a member that functions as a partition between a development section and a container section so that a large amount of toner will not go into the development section when a development apparatus is new. When a development apparatus of such a model that is new is used for the first time, it is necessary to remove the toner sealer.

However, when a development apparatus that includes a belt-shaped conveying member according to related art is used, undesirable situations can arise.

Specifically, a user might forget to remove the toner sealer and might attach a development apparatus, with the toner sealer unremoved, to the body of an image forming apparatus.

Additionally, sometimes a large amount of toner is on a removed toner sealer. Therefore, user's fingers or clothes, etc. sometimes get dirty with the toner.

For this reason, enhanced usability (ease of use) is demanded.

SUMMARY OF THE INVENTION

Embodiments of the present disclosure provide a developer container, comprising: a casing that contains developer; and a belt-shaped conveying member configured to convey the developer and including a partitioning portion, the partitioning portion being a partition for the developer contained in the casing with respect to a conveying direction in which the developer is conveyed, wherein the partitioning portion is in contact with an interior surface of the casing when new and extends in a direction intersecting with the conveying direction in which the developer is conveyed, and wherein, when the developer container is new, a first developer amount, which is an amount of the developer contained at an upstream side that is upstream of the partitioning portion in the conveying direction, is larger than a second developer amount, which is an amount of the developer contained at a downstream side that is downstream of the partitioning portion in the conveying direction.

Embodiments of the present disclosure further provide a development apparatus, a process cartridge, and an image forming apparatus.

Further features of the present disclosure will become apparent from the following description of exemplary embodiments with reference to the attached drawings.

DESCRIPTION OF THE EMBODIMENTS

With reference to the accompanying drawings, some exemplary embodiments of the present disclosure will now be explained in detail.

First Embodiment

The dimension, material, and shape of components described in embodiments, and the relative arrangement of these components, are to be modified depending on the structure of an apparatus to which the embodiment is applied, and depending on various conditions. The specific description below shall not be construed as any intent to restrict the scope of the present disclosure to the given embodiments.

Structure of Development Unit According to First Embodiment

Figure 1:
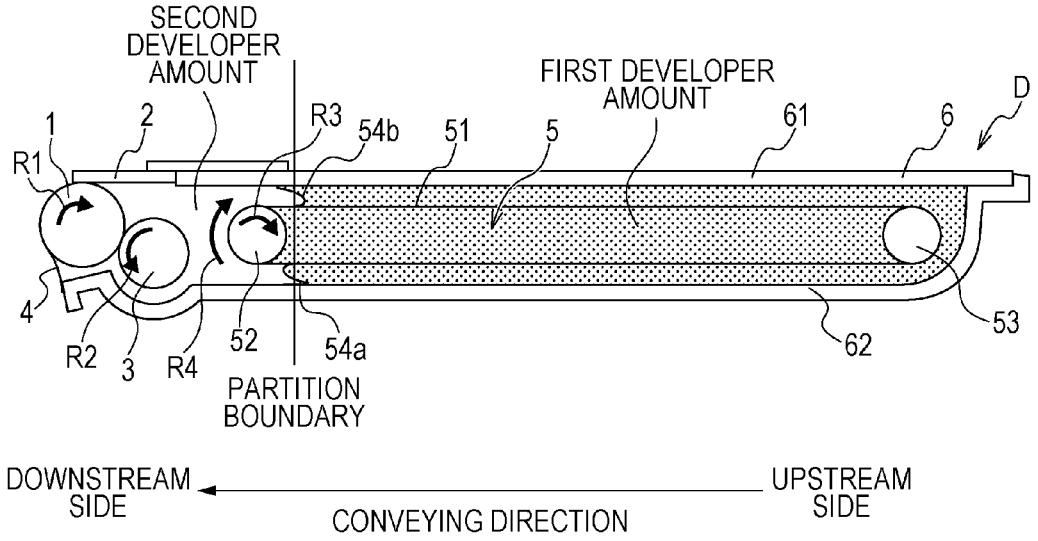
FIG. 1 is a schematic cross-sectional view of the structure of a development unit according to a first embodiment.

FIG. 1 is a schematic cross-sectional view of the structure of a development unit D, which is a development apparatus according to a first embodiment. As illustrated in FIG. 1, the development unit D includes a development roller 1, a regulation blade 2, and a supply roller 3. The development roller 1 is an example of a developer bearing member. The regulation blade 2 is an example of a regulation member for controlling the layer thickness of developer. The supply roller 3 is an example of a developer feed member. The development unit D further includes an effusion stopper sheet 4, which prevents developer from going out, a conveying belt 5, and a casing 6. The conveying belt 5 is an example of a developer conveying member. Developer is contained in the casing 6.

The development unit D contains, as an example of the developer, a toner of any one of yellow, magenta, cyan, and black.

Each of the development roller 1 (developer bearing member) and the supply roller 3 (developer feed member) has a shaft. These two rollers are provided in parallel to each other. In the description below, the term "axial direction" means the axial direction of the development roller 1 and the supply roller 3, unless otherwise specified. In the first embodiment, the axial direction of a driving shaft for driving a belt-shaped conveying member is the same as the axial direction of the development roller 1 and the supply roller 3. Similarly, the term "depth direction" in the description below means the horizontal direction in the schematic cross-sectional view of FIG. 1, unless otherwise specified. The left side at which the development roller 1 and the supply roller 3 are provided in FIG. 1 is defined as near side in the depth direction. The right side in FIG. 1 is defined as far side in the depth direction. The term "thickness direction" in the description below means the vertical direction in the schematic cross-sectional view of FIG. 1, unless otherwise specified. The top/upper position where the regulation blade 2 is provided in FIG. 1 is defined as "upper/above" in the thickness direction. The lower position where the effusion stopper sheet 4 is provided in FIG. 1 is defined as "lower/below" in the thickness direction.

The direction from the right to the left in the schematic cross-sectional view of FIG. 1 is defined as conveying direction for supplying developer to the development roller 1 (developer bearing member).

The development roller 1 is an elastic roller and rotates in the direction indicated by an arrow R1. The regulation blade 2 is a flat plate made of SUS. Being in contact with the development roller 1, the regulation blade 2 regulates the amount of a toner on the development roller 1 at a predetermined constant level. The supply roller 3 is made of a foam material that is capable of containing a toner inside itself. Being in contact with the development roller 1, the supply roller 3 rotates in the direction indicated by an arrow R2 to supply a toner to the development roller 1. The effusion stopper sheet 4 is a flexible sheet member. Being in contact with the development roller 1, the effusion stopper sheet 4 prevents the leakage of a toner from the casing 6.

The casing 6 is mainly made up of two frame parts. The upper part in the thickness direction is a top cover 61. The lower part in the thickness direction is a casing body 62. In the casing 6, the two axis-directional sidewalls (not illustrated) and the depth-directional far-side wall constitute an integral part of the casing body 62. Having such a structure, the casing body 62, which is the lower part of the casing, fulfills a container function. The top cover 61 has a shape of a flat plate. As its name suggests, the top cover 61 serves as a cover. The top cover 61 and the casing body 62 are welded to each other at plural places to constitute the casing 6 functioning as a developer container.

The conveying belt 5 is a belt-shaped conveying member. A flexible belt-shaped (or "tubular") conveying sheet 51 is supported by a driving shaft 52 and a supporting shaft 53, which are axially in parallel with the development roller 1 and the supply roller 3. The conveying sheet 51 is a polyethylene terephthalate (PET) sheet that has a thickness of 300 μm. The tubular shape of the conveying sheet 51 is formed by looping a single sheet to overlap its two ends with each other and by heat-pressing the overlap end region.

Due to the rotation of the driving shaft 52 in the direction indicated by an arrow R3, the conveying sheet 51 performs circulating motion in the direction indicated by an arrow R4. In the description below, the term "circulating direction" means the circulating direction of the conveying belt 5, more specifically, the conveying sheet 51, unless otherwise specified. Therefore, the circulating direction is not the same at every position in the depth direction and the thickness direction of the development unit D, meaning that said direction changes depending on the phase of the conveying sheet 51.

In the description below, "inside (or outside) the conveying belt 5 and the conveying sheet 51" means the inside (or outside) of the tubular conveying sheet 51, unless otherwise specified. Therefore, the driving shaft 52 and the supporting shaft 53 are provided inside the conveying belt 5.

Structure of Image Forming Apparatus According to First Embodiment

Next, the structure of an image forming apparatus 100 according to the first embodiment will now be explained. In addition, image forming processes in the first embodiment will now be explained.

Figure 2:
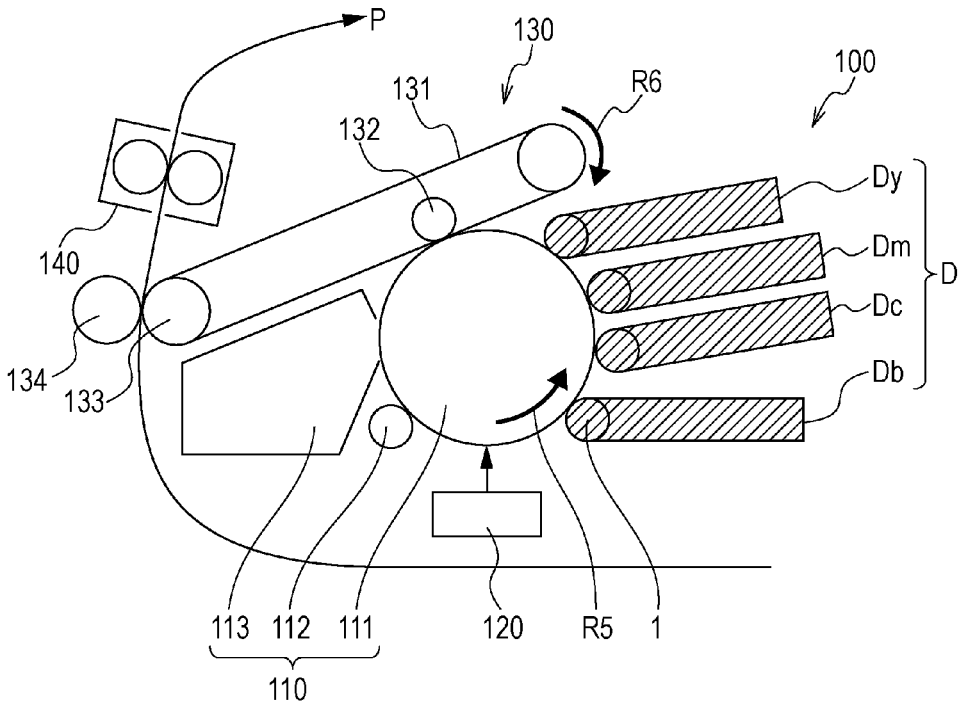
FIG. 2 is a schematic cross-sectional view of the structure of an image forming apparatus according to the first embodiment.

FIG. 2 is a schematic cross-sectional view of the structure of an image forming apparatus 100 according to the first embodiment.

The image forming apparatus 100 is provided with development units Dy, Dm, Dc, and Db that are detachably attached to the body of the apparatus. The colors of toners contained respectively in these development units are different from one another. Specifically, the colors are: yellow y, magenta m, cyan c, and black b. The image forming apparatus 100 is further provided with an integrated cleaning unit 110 that is detachably attached to the body of the apparatus. The cleaning unit 110 includes a photosensitive drum 111, which is an example of an image bearing member, a charging roller 112, which is an example of an electric charger, and a cleaning member 113.

A part of image forming operation is performed in a state in which the development units Dy, Dm, Dc, and Db and the cleaning unit 110 are attached to the body of the apparatus.

The photosensitive drum 111 is electrically charged into predetermined polarity and potential by the charging roller 112 while rotating in the direction indicated by an arrow R5. A laser beam emitted from an exposure unit 120 impinges on the surface of the photosensitive drum 111. An electrostatic latent image is formed thereon due to the exposure.

The development roller 1 (developer bearing member) is configured to be able to come into contact with, and away from, the photosensitive drum 111 (image bearing member). In a state of contact of the development roller 1 with the photosensitive drum 111, a toner is supplied from the development roller 1 to the surface of the photosensitive drum 111. The supply of the toner visualizes the electrostatic latent image on the drum. As a result, a toner image (developed image) is formed on the drum.

The toner image on the photosensitive drum 111 is primarily transferred to an intermediate transfer unit 130 by means of a bias applied to a primary transfer roller 132.

After the primary transfer to the intermediate transfer unit 130, the toner image is carried due to the circulating movement of an intermediate transfer belt 131 in the direction indicated by an arrow R6 to a secondary transfer position, which is the region of nip between a secondary transfer roller 133 and an opposite secondary transfer roller 134.

Then, the toner image is secondarily transferred to a recording medium P at the secondary transfer position. After the secondary transfer to the medium P, a fixing unit 140 applies heat and pressure so as to fix the toner image on the medium P. A final image is obtained in this way.

The residual part of the toner, which remains on the surface of the photosensitive drum 111 without having been transferred to the intermediate transfer unit 130, is carried to the cleaning member 113. The residual part of the toner is scraped off from the surface of the photosensitive drum 111 thereat.

Structure of Conveying Belt According to First Embodiment

Next, the structure of the conveying belt 5, which is a belt-shaped conveying member according to the first embodiment, will now be explained.

Figure 3:
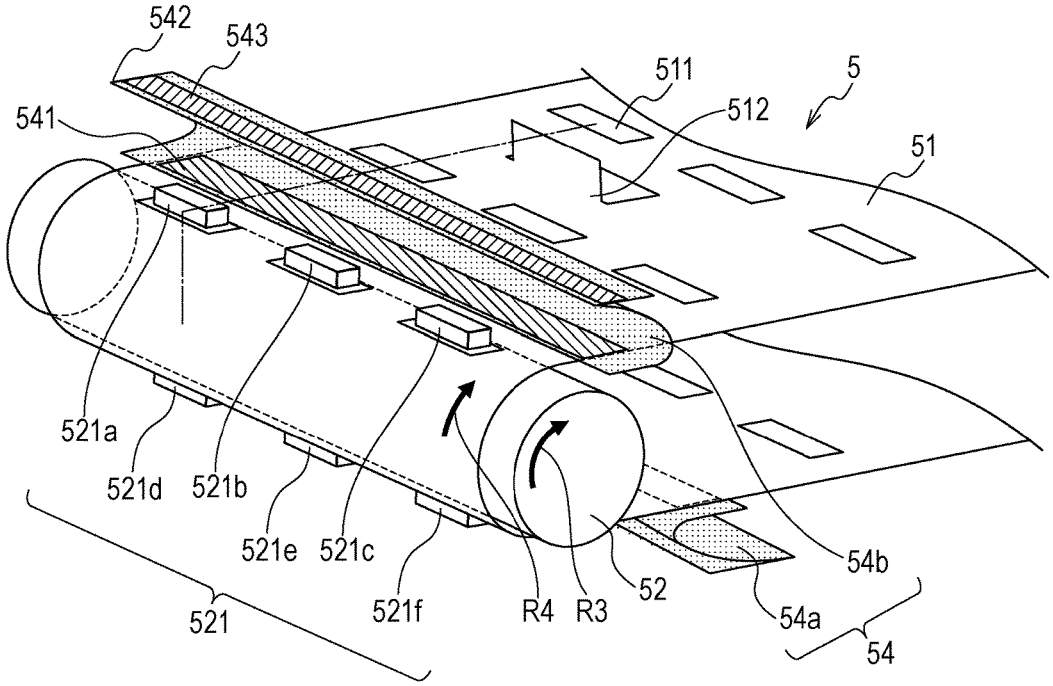
FIG. 3 is a schematic perspective view of the structure of a conveying belt according to the first embodiment.

FIG. 3 is a schematic perspective view of a part of the conveying belt 5 at the near side in the depth direction, specifically, a part of the conveying sheet 51 in the neighborhood of the driving shaft 52.

The driving shaft 52 has a columnar body that has a diameter of 20 mm, and further has plural protrusions 521. The protrusions 521 include plural protrusions 521*a*, 521*b*, and 521*c*, which are arranged in a line in the axial direction, and further include plural similar opposite protrusions at the same "phase" as viewed in the circumferential direction of the driving shaft 52. That is, at each predetermined position in the axial direction, two of the protrusions 521 are provided with an angular shift of 180° in phase from each other as viewed in the circumferential direction of the driving shaft 52. The two constitute an opposite pair each, as in the protrusions 521*a* and 521*d*, and the protrusions 521*b* and 521*e*. Each of the protrusions 521 has a shape of a rectangular parallelepiped and is an integral part of the driving shaft 52.

The conveying sheet 51 has plural insertion slits 511. In the axial direction, the positions of the insertion slits 511 are the same as those of the protrusions 521. In the circulating direction, the insertion slits 511 are formed at equal intervals corresponding to one half of the circumference of the driving shaft 52, more specifically, at intervals of 31.4 mm.

Receiving motive power from the image forming apparatus 100 via gears that are not illustrated, the driving shaft 52 rotates in the direction indicated by the arrow R3. In the course of the rotation of the driving shaft 52, the protrusions 521 are inserted into the insertion slits 511. Due to the rotation of the driving shaft 52 in this state, the motive power is transmitted from the driving shaft 52 to the conveying sheet 51 via the protrusions 521, and the conveying sheet 51 travels in a circulating manner in the direction indicated by the arrow R4. When the driving shaft 52 rotates approximately by 180°, the protrusions 521 are inserted into different insertion slits 511 that were located upstream of the driving shaft 52 in the circulating direction, and the transmission of the motive power to the conveying sheet 51 continues. This realizes the continuous circulating motion of the conveying belt 5. Each of the insertion slits 511 has a rectangular shape and has designed size that is slightly larger than the protrusion 521 both in the axial direction and in the circulating direction. The larger size of opening makes the insertion of the protrusion 521 into the insertion slit 511 easier.

The conveying sheet 51 has plural belt protrusions, specifically, conveying blades 512. The conveying blade 512 is a cut-and-folded part produced by, first, forming a bracket-shaped cut in the conveying sheet 51, meaning that the upstream side of the bracket region in the circulating direction remains uncut, and next by folding the bracket region toward the outside of the conveying belt 5. Such a blade structure enhances the effect of conveying a toner in the circulating direction when the conveying sheet 51 travels in a circulating manner. For this reason, preferably, a material that is rigid enough so as not to yield to toner particle pressure should be selected for the conveying blade 512, that is, as the material of the conveying sheet 51.

A sealing member 54, which is an example of a partitioning member, is provided integrally with the conveying sheet 51. In the present embodiment, the partitioning member and the conveying sheet are different members. However, a part of the conveying sheet may function as a partition. Its specific structure will be described later. The sealing member 54 functioning as the partitioning member is a flexible PET sheet that has a thickness of 100 μm. The width of the sealing member 54 in the axial direction (longitudinal direction of the partitioning member) is greater than that of the conveying sheet 51. In addition, the partitioning member is longer than the insertion slits in the longitudinal direction. Regarding the length from the conveying sheet portion to the free end, the sealing member, that is, the partitioning member, is longer than the conveying blade, that is, the belt protrusion. The sealing member 54 is joined to the conveying sheet 51 by being heat-pressed onto the conveying sheet 51 at its joined portion 541. In addition to the joined portion 541, the sealing member 54 has a folded portion 542 and a bonded portion 543. Specifically, the sealing member 54 is folded back and adhesively bonded at the opposite end region to the interior surface of the casing 6. A double-sided adhesive tape is used for the bonding of the bonded portion 543. The adhesive strength of the bonded portion 543 is designed to be less than the joining strength of the joined portion 541.

Toner-Filling Operation and Seal-Breaking Operation According to First Embodiment Next, the operation of putting a toner into the development unit D and the operation of breaking the seal according to the first embodiment will now be explained.

FIG. 4 is a set of cross-sectional diagrams illustrating the structure of the development unit D as in FIG. 1, wherein A to D show sequential processes starting with toner-filling operation, followed by seal-breaking operation (unsealing operation) to go into a toner-present state, in which it is possible to perform development operation.

Figure 4A:
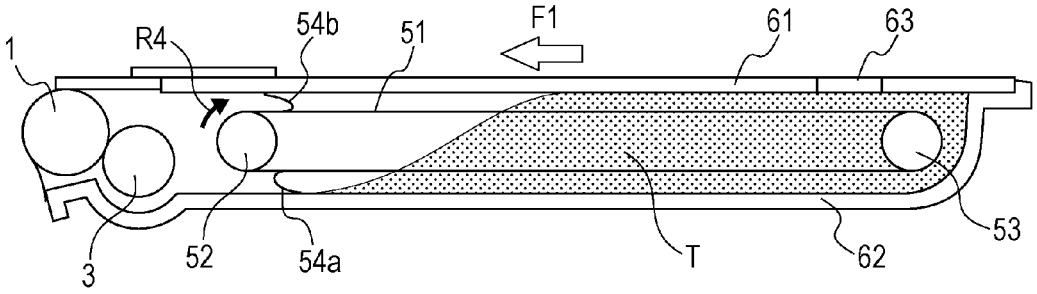
FIG. 4A is a schematic cross-sectional view of the structure of the development unit according to the first embodiment.

As illustrated in FIG. 4A, a first sealing member 54*a* and a second sealing member 54*b* (first and second partitioning members), are provided on the conveying belt 5. The phase of the conveying belt 5 has been adjusted in advance in such a way that the first sealing member 54*a* and the second sealing member 54*b* are located near the driving shaft 52, wherein one of these two sealing members, 54*a*, is located upstream of the driving shaft 52 in the circulating direction, and the other, 54*b*, is located downstream of the driving shaft 52 in the circulating direction. That is, the first sealing member 54*a* is bonded to the casing body 62, and the second sealing member 54*b* is bonded to the top cover 61. In other words, these two sealing members are bonded in a state of being in contact with the floor and ceiling respectively, as viewed in the direction of gravity. Therefore, a space is formed by the first sealing member 54*a*, the second sealing member 54*b*, the conveying sheet 51, and the interior surface of the casing 6. The developer is contained inside the space. The top cover 61 has a toner inlet 63. The toner inlet 63 is located near the supporting shaft 53, that is, at the far side in the depth direction. Therefore, a toner T having been poured in through the inlet 63 moves from the far side toward the near side in the depth direction, that is, in the direction indicated by an arrow F1, in accordance with the progress of toner-filling operation. The direction indicated by the arrow F1 is the same as the direction of toner conveyance. Since the conveying sheet 51 has the insertion slits 511 as described earlier (refer to FIG. 3), the toner is allowed to move to the inside/outside of the conveying belt 5 through the insertion slits 511.

Figure 4B:
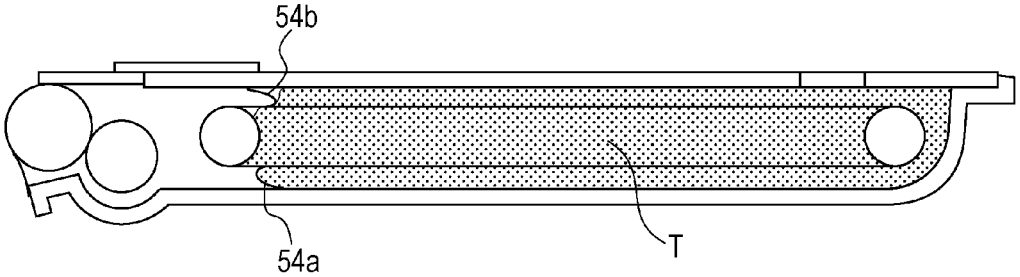
FIG. 4B is a schematic cross-sectional view of the structure of the development unit according to the first embodiment.

FIG. 4B illustrates a state after the progress of toner-filling operation from the state illustrated in FIG. 4A. The space defined by the conveying sheet 51 and the walls, floor, and ceiling of the casing 6 is partitioned by the first sealing member 54*a* and the second sealing member 54*b* functioning as partitioning members. The partitioning members extend in the direction intersecting with the conveying direction. Therefore, the advancement of the toner (toner conveyance) is blocked by the first sealing member 54*a* and the second sealing member 54*b*. The space to be filled with the toner is located at the upstream side in the conveying direction with respect to the sealing member (partitioning member). The other space at the opposite side of the partition is located at the downstream side in the conveying direction. For this reason, a first developer amount, which is the amount of developer contained at the upstream side, is larger than a second developer amount, which is the amount of developer contained at the downstream side (FIGS. 1 and 4B). In the present embodiment, the second developer amount is 0 g. However, the second developer amount is not limited to 0 g. For example, in some cases, the surface of a development roller is coated with a toner for the purpose of roller lubrication. Therefore, the second developer amount may be any value within a range from 0 g inclusive to 5 g or so. Anyway, the first developer amount is larger than the second developer amount when the developer container (or development apparatus) is new. A general rule of thumb is that the second developer amount is not greater than one fiftieth of the first developer amount.

In this "filled-with-toner" state, the inlet 63 is closed to end the toner-filling process. Therefore, in mint condition, a toner is present inside the development unit D as illustrated in FIG. 4B. That is, in mint condition, a large amount of developer (first developer amount) is contained at the upstream side in the conveying direction, wherein the partitioning member is the boundary.

Next, the operation of breaking the seal will now be explained. When a development unit D that is in mint condition is attached to the image forming apparatus 100 that is in a power ON state, the image forming apparatus 100 is activated. Due to the activation, motive power is supplied to the driving shaft 52 via the gears that are not illustrated, and the driving shaft 52 starts to rotate in the direction indicated by the arrow R3.

Since the two ends of each of the first sealing member 54*a* and the second sealing member 54*b* are fixed respectively to the conveying sheet 51 and the casing 6, a tensile force acts on each of the first sealing member 54*a* and the second sealing member 54*b* when the driving shaft 52 starts to rotate. As described earlier, the strength of adhesive bonding of the bonded portion 543 of each of the first sealing member 54*a* and the second sealing member 54*b* to the casing 6 is designed to be less than the strength of joining of the joined portion 541 of each of the first sealing member 54*a* and the second sealing member 54*b* to the conveying sheet 51. For this reason, the bonded portion 543 peels off gradually, whereas the joined portion 541 remains on the conveying sheet 51.

Preferably, the sealing member 54 should have the fold 542 as illustrated in FIG. 3. The bend increases, among components of a tensile force acting on the bonded portion 543, a component acting not in the shear direction of the bonded surface but in the perpendicular direction. Because of the increased perpendicular component, it is possible to cause the bonded portion 543 to peel off by means of a lower tensile magnitude.

Figure 4C:
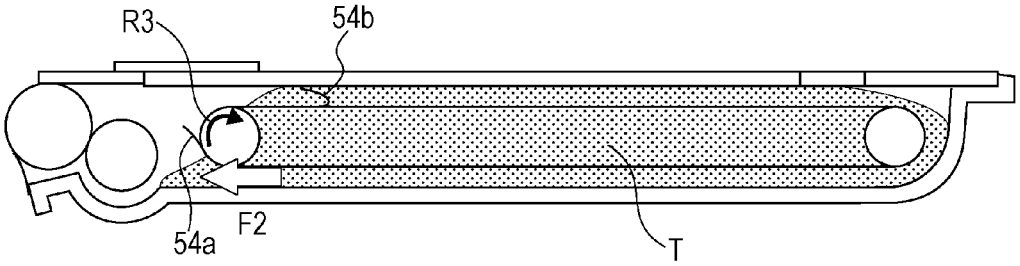
FIG. 4C is a schematic cross-sectional view of the structure of the development unit according to the first embodiment.
Figure 4D:
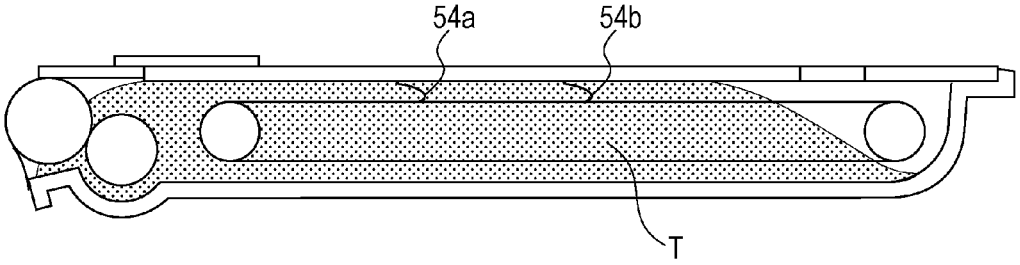
FIG. 4D is a schematic cross-sectional view of the structure of the development unit according to the first embodiment.

After that, as illustrated in FIG. 4C, the first sealing member 54*a* and the second sealing member 54*b* move to the downstream side in the circulating direction respectively from their mint-condition positions illustrated in FIG. 4B. As a result, the first sealing member 54*a* comes off of the floor of the casing body 62, and the space formed by the conveying sheet 5 and the interior surface of the casing 6 opens. In this process, the toner moves in the direction indicated by an arrow F2 (conveying direction) gradually by receiving the force of propulsion mainly from the second sealing member 54*b* and the conveying blades 512 (refer to FIG. 3). Finally, the toner is supplied to the supply roller 3 and then to the development roller 1, resulting in a developable toner-present state illustrated in FIG. 4D.

In this way, the embodiment described above provides a solution to the problem of user's forgetting to remove the toner-sealing member when starting to use the development unit. Moreover, since troublesome removal of the toner-sealing member is unnecessary, usability (ease of use) improves.

In addition, the embodiment described above enhances the performance of toner conveyance of the conveying belt 5 because the sealing member 54 moves in a circulating manner in a state of continuously extending in the axial direction and of being in contact with the interior surface of the casing 6 when the development unit D is in use.

A predetermined torque is required for the peeling off of the bonded portion 543. When two sealing members such as the first sealing member 54*a* and the second sealing member 54*b* of the first embodiment are used for sealing, a larger peeling-off torque is required if bonded portions at two places peel off at the same time. In view of this fact, the "length" of the first sealing member 54*a* and the "length" of the second sealing member 54*b* may be set to be different from each other; more specifically, the distance from the joined portion 541 to the bonded portion 543 of one of the two sealing members may be set to be different from that of the other. The difference in length makes the peeling-off timing of the one of the two sealing members asynchronous with that of the other. Since the shift in peeling-off timing makes the timing of a torque increase for the one of the two sealing members different from that of the other, it is possible to reduce a maximum torque.

In the embodiment described above, thermal welding is used as a method for forming the joined portion 541 of the sealing member 54, that is, the portion joined to the conveying sheet 51. However, the joining method is not limited to thermal welding. For example, an adhesive or a double-sided tape, or ultrasonic welding, may be used instead of thermal welding. Alternatively, a protrusion, a pin, or the like may be hooked into a hole or the like. Similarly, the medium for bonding the bonded portion 543 of the sealing member 54 to the casing 6 is not limited to a double-sided tape. Though various modifications are available, it is necessary to select the method of forming the joined portion 541 and the method of forming the bonded portion 543 in such a way that the joining strength of the joined portion 541 is greater than the adhesive strength of the bonded portion 543. The reason is as follows. If the joining strength of the joined portion 541 were less than the adhesive strength of the bonded portion 543, the joined portion 541, not the bonded portion 543, would come off, which might result in insufficient toner supply.

In the embodiment described above, different members that are not a part of the conveying sheet 51 are joined as the material of the sealing member 54 to the conveying sheet 51. However, the sealing member 54 and the conveying sheet 51 may be made of an identical material.

FIG. 5 is a set of concept diagrams illustrating a part of the process of forming the conveying sheet 51 from a sheet shape into a belt shape. Among them, FIG. 5A is a schematic top view of the sheet material of the conveying sheet 51 before being formed into a belt shape. FIG. 5B is a schematic cross-sectional view of the conveying sheet 51 in a case where different members that are not a part of the conveying sheet 51 are joined as the material of the sealing member 54 to the conveying sheet 51. Each of FIGS. 5C, 5D, and 5E is a schematic cross-sectional view of the conveying sheet 51 in a case where the sealing member 54 and the conveying sheet 51 are made of an identical material.

Figure 5A:
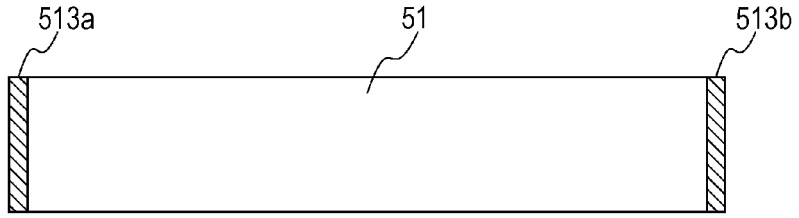
FIG. 5A is a schematic top view of a conveying sheet material according to the first embodiment.

As illustrated in FIG. 5A, the conveying sheet 51 has a rectangular shape before being formed into a belt shape. To facilitate the understanding of the description below, the region located at one end of the conveying sheet 51 is defined as first end 513*a*, and the region located at the opposite end of the conveying sheet 51 is defined as second end 513*b*. The front and back of the sheet material are not specifically mentioned in the description below. Therefore, the above definition of "end" encompasses both of the front surface and back surface.

Figure 5B:
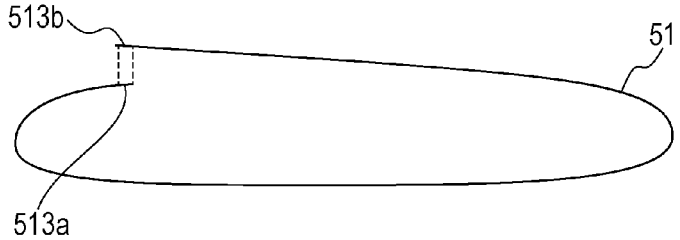
FIG. 5B is a concept diagram illustrating an example of the process of forming a conveying sheet according to the first embodiment.
Figure 5C:
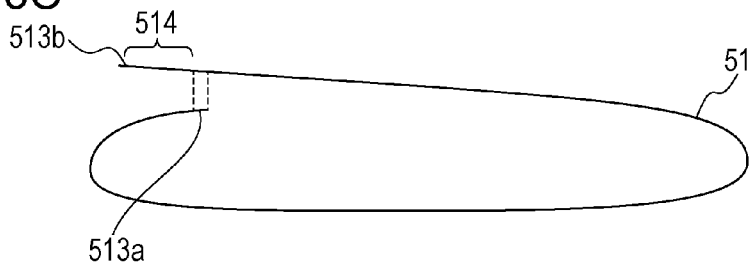
FIG. 5C is a concept diagram illustrating another example of the process of forming the conveying sheet according to the first embodiment.
Figure 5D:
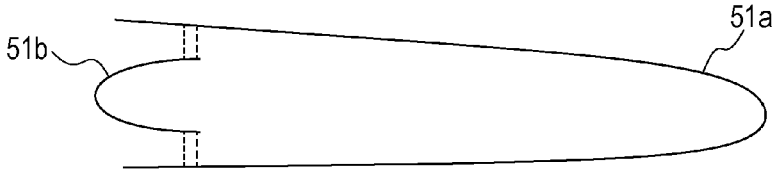
FIG. 5D is a concept diagram illustrating another example of the process of forming the conveying sheet according to the first embodiment.

As illustrated in the schematic cross-sectional diagram of FIG. 5B, basically, the conveying sheet 51 is formed into an endless belt shape by bonding the two ends (513*a* and 513*b*) of the conveying sheet 51 to each other. If one end 513*a* of the conveying sheet 51 is bonded to a non-end region that is apart from the other end 513*b* as illustrated in the schematic cross-sectional diagram of FIG. 5C, the portion including the end 513*b* is a free end portion. The free end portion 514 formed in this way may have the function of the partitioning member described above. In FIGS. 5C and 5D, a part of the conveying sheet 51, not different members, plays the role of the partitioning portion.

Figure 5E:
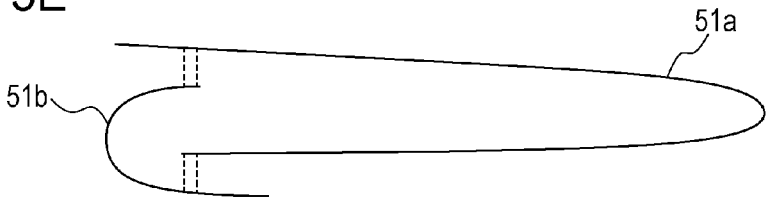
FIG. 5E is a concept diagram illustrating another example of the process of forming the conveying sheet according to the first embodiment.

As illustrated in the schematic cross-sectional diagrams of FIGS. 5D and 5E, two sheets 51*a* and 51*b* for producing a conveying sheet may be combined with each other to form a belt shape. When these two sheets are combined with each other, as illustrated in FIG. 5D, the two ends of one of these two sheets, 51*a*, may be free ends. Alternatively, as illustrated in FIG. 5E, each of the two sheets 51*a* and 51*b* may have a free end.

These variation examples make it unlikely that the sealing member 54 comes off of the conveying sheet 51. Moreover, it is possible to reduce the number of members.

Figure 6:
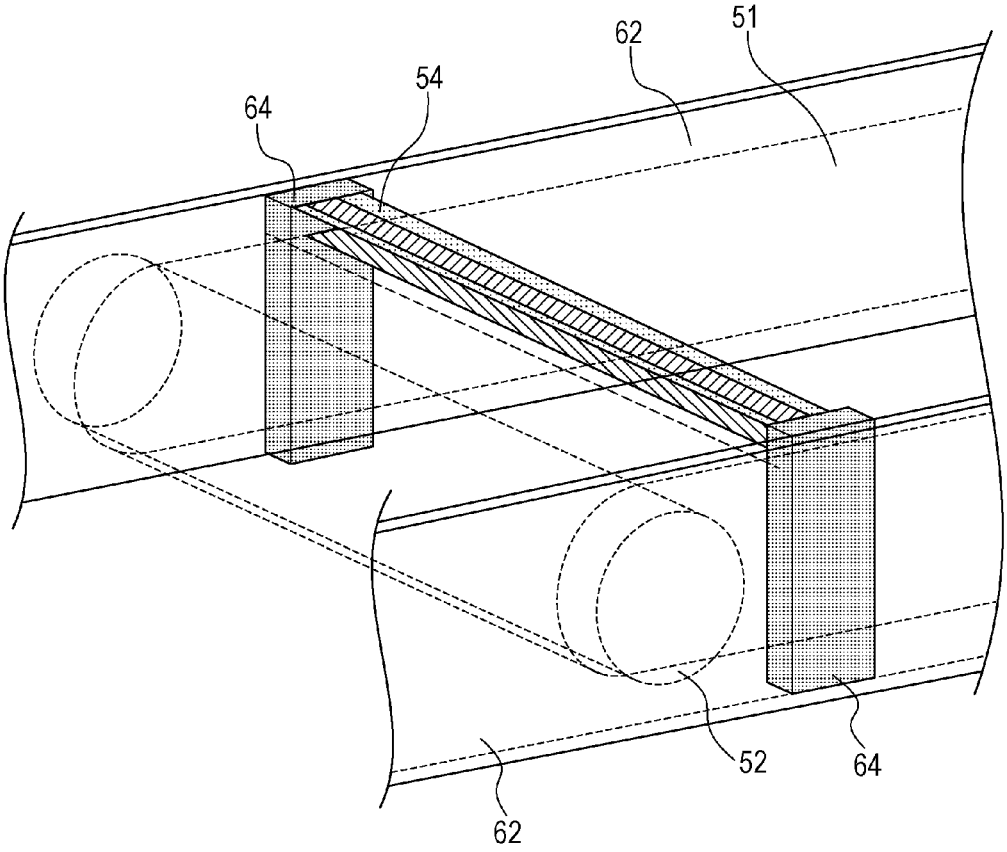
FIG. 6 is a schematic perspective view of the structure of a development unit according to a variation example of the first embodiment.

A member for reducing the entry of a toner at the end in the axial direction, that is, the entry of a toner through the clearance between the conveying belt 5 and the casing 6, may be additionally provided. FIG. 6 is a schematic perspective diagram illustrating the conveying belt 5 similarly to FIG. 3. The contour lines of the casing body 62 are also shown in FIG. 6. To facilitate the understanding of the concept of the illustrated structure, some of the members and portions, etc. are omitted, as can be seen from the comparison with FIG. 3. As illustrated in FIG. 6, an elastic sealing pad 64 may be provided on and inside each of the two sidewalls of the casing body 62 so as to reduce the entry of a toner through the clearance between the conveying belt 5 and the casing 6. When the phase of the conveying belt 5 is adjusted in the toner-filling process, the joined portion 541 and the bonded portion 543 of the sealing member 54 are positioned to be in alignment with the sealing pads 64. By this means, it is possible to enhance toner-sealing property.

In the embodiment described above, the insertion slits 511 are formed for the purpose of transmitting motive power from the driving shaft 52 to the conveying sheet 51. However, the conveying sheet 51 may have plural holes in addition to the insertion slits 511. That is, additional holes may be bored at positions where the protrusions 521 are not inserted. The additional holes make the movement of the toner to the inside/outside of the conveying belt 5 more active.

Second Embodiment

In the first embodiment, for the purpose of partitioning the space formed by the top cover 61, the casing body 62, and the conveying belt 5 into two parts of the space, two sealing members, specifically, the first sealing member 54*a* and the second sealing member 54*b*, are provided as separate partitioning members that are connected respectively to the casing body 62 and the top cover 61. Instead, the partition for demarcating the toner space may be a single sealing member 54*c* functioning as the partitioning member.

Figure 7:
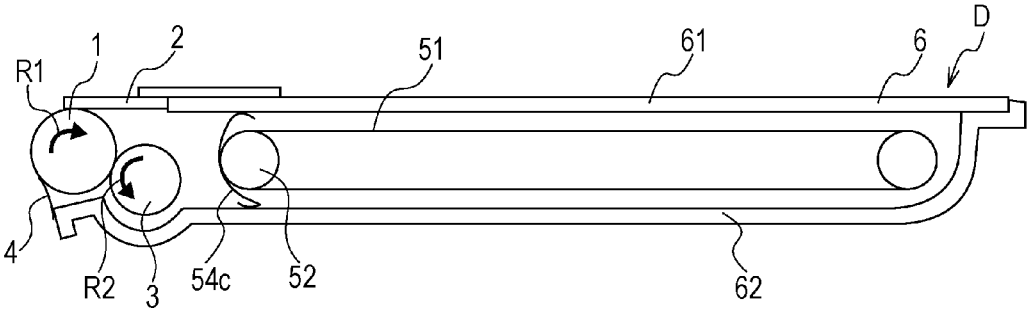
FIG. 7 is a schematic cross-sectional view of the structure of a development unit according to a second embodiment.

For example, as illustrated in the schematic cross-sectional diagram of FIG. 7, the toner space may be sealed by joining the center of a single sealing member 54*c* to the conveying sheet 51 to configure each of the two ends of the sealing member 54*c* in the circulating direction as a free end and by adhesively bonding the respective free ends to the top cover 61 and the casing body 62.

Figure 8:
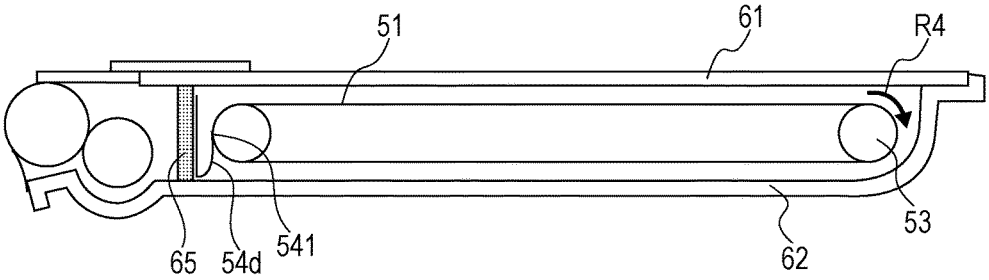
FIG. 8 is a schematic cross-sectional view of the structure of a development unit according to a variation example of the second embodiment.

Another modified structure is illustrated in the schematic cross-sectional diagram of FIG. 8 and the schematic perspective diagrams of FIG. 9. To facilitate the understanding of the concept of the illustrated structure, as in FIG. 6, some of the members and portions, etc. are omitted in the schematic perspective diagrams of FIG. 9.

Figure 9A:
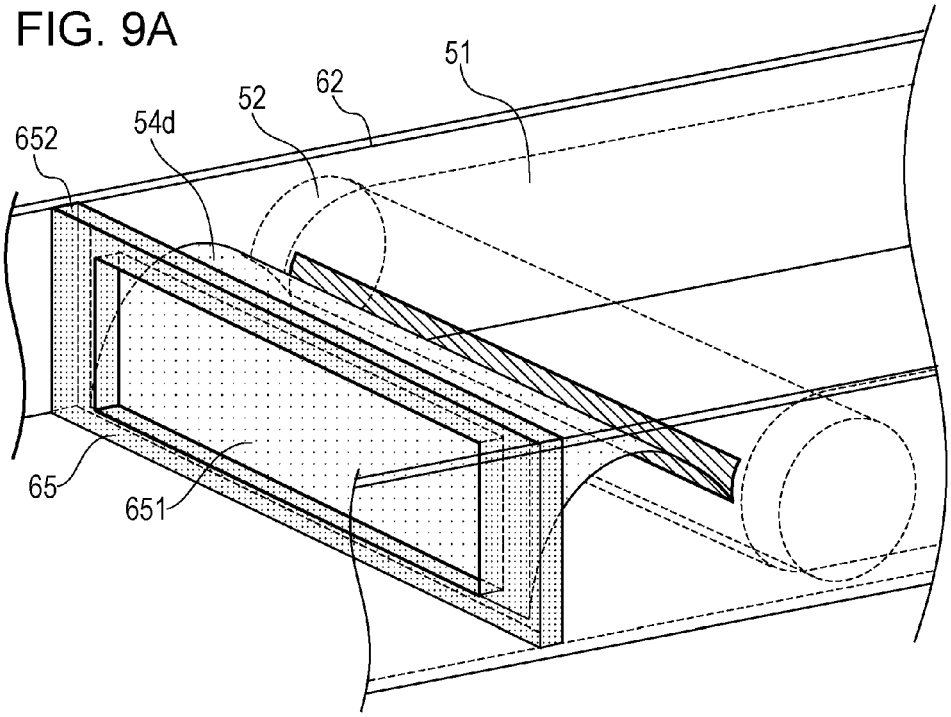
FIG. 9A is a schematic perspective view of the structure of the development unit according to the variation example of the second embodiment.
Figure 9B:
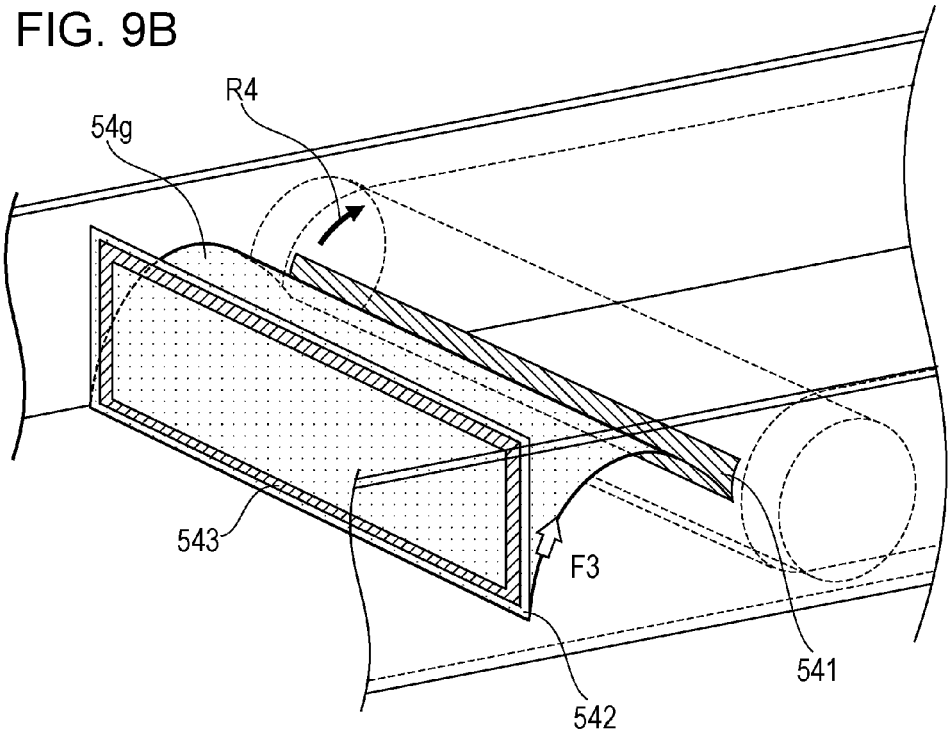
FIG. 9B is a schematic perspective view of the structure of the development unit according to the variation example of the second embodiment.

The development unit D illustrated in FIG. 9A has a casing partition 65. FIG. 9B is a schematic perspective diagram in which the casing partition 65 is omitted for the convenience of explanation.

The casing partition 65 is a frame that has an opening 651 at its center. The casing partition 65 is formed integrally with the floor and two sidewalls of the casing body 62. Through the fixing of the top cover 61 to the casing body 62 in the assembly process, the top surface 652 of the casing partition 65 is in hermetic contact with the top cover 61.

A sealing member 54*d* functioning as the partitioning member is made of a flexible sheet. One end of the sealing member 54*d* is fixed to the conveying sheet 51. The opposite end of the sealing member 54*d* is adhesively bonded. Specifically, as illustrated in FIG. 9B, the sealing member 54*d* has a folded portion 542 and a bonded portion 543. The bonded portion 543 is fixed to the casing partition 65. The bonded portion 543 exists continuously in a shape of a frame and does not exist at the opening 651 of the casing partition 651. Therefore, when the toner space is filled with a toner in the same way as in the first embodiment, the sealing member 54*d* functions as the partitioning member.

The development unit D is thereafter attached to the image forming apparatus 100 as in the first embodiment. Due to motive power transmission to the driving shaft 52, the conveying sheet 51 travels in a circulating manner in the direction indicated by the arrow R4. When the conveying sheet 51 moves, a tensile force acts on the sealing member 54*d* in the direction indicated by an arrow F3. Because of the tensile force, the bonded portion 543 of the sealing member 54*d* peels off of the casing partition 65 gradually. Therefore, the sealing member 54*d* functioning as the partitioning member comes apart from the frame of the casing partition 65 to unseal the opening 651. The toner is supplied to the neighborhood of the development roller 1 through the opening 651.

Third Embodiment

In the first and second embodiments, the sealing member 54 is adhesively bonded to the casing 6 for sealing the toner space. In contrast, in the present embodiment, the sealing member 54 is in contact with the interior surface of the casing 6 due to the tension of the sheet material. This is called as light sealing (partitioning).

Figure 10:
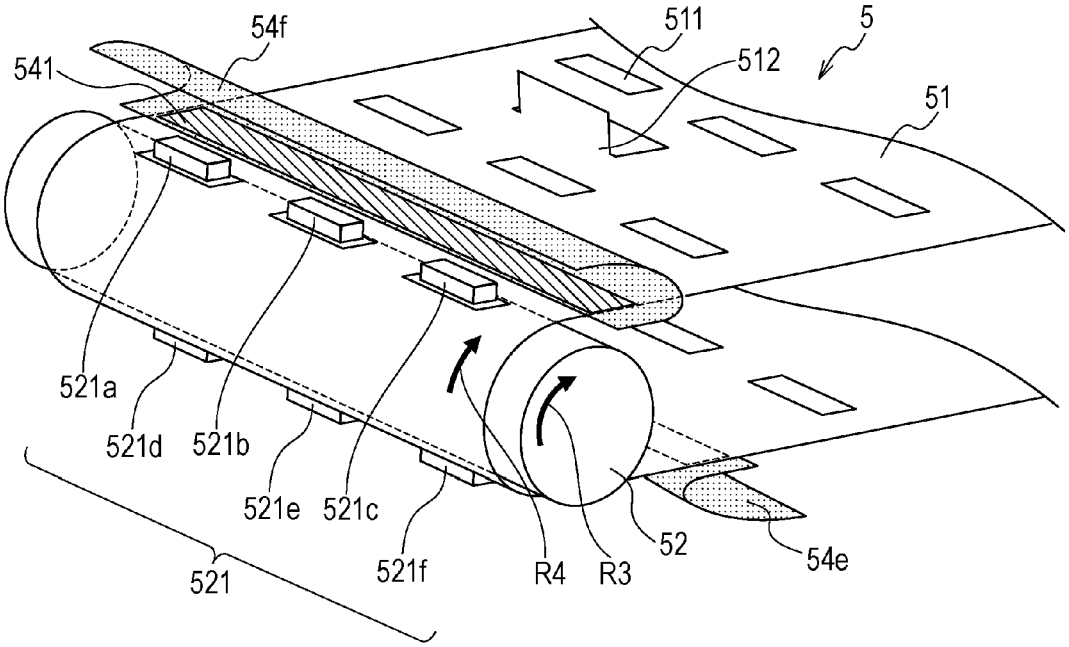
FIG. 10 is a schematic perspective view of the structure of a development unit according to a third embodiment.

FIG. 10 is a schematic perspective view of a development unit D according to a third embodiment.

As illustrated in FIG. 10, each of a first partitioning member 54*e* and a second partitioning member 54*f* has a joined portion 541 at its one end. The region of this end is heat-pressed onto the conveying sheet 51 to be joined to the conveying sheet 51, which is the same as the structure explained earlier with reference to FIG. 3. The opposite end of each of the first partitioning member 54*e* and the second partitioning member 54*f* is a free end. The free length of each of the first partitioning member 54*e* and the second partitioning member 54*f* is designed to be sufficient in relation to the clearance between the surface of the conveying sheet 51 and the interior surface of the casing 6. Therefore, in a state in which the conveying belt 5 has been mounted into the casing 6, each of the first partitioning member 54*e* and the second partitioning member 54*f* is in contact with the interior surface of the casing 6. Specifically, the first partitioning member 54*e* is in contact with the floor, that is, the interior surface of the casing body 62, and the second partitioning member 54*f* is in contact with the ceiling, that is, the interior surface of the top cover 61. The partition for the space formed by the first and second partitioning members, the conveying sheet 51, and the interior surface of the casing 6 is provided in this way.

If the sealing member 54 is adhesively bonded to the casing 6 for toner sealing as in the first embodiment, a large torque of a certain magnitude is necessary for the bonded portion 543 of the sealing member 54 to peel off of the casing 6. In contrast, if light sealing is used as in the third embodiment, a smaller torque is enough for breaking the seal.

In addition, light sealing makes the assembly process of the development unit D simpler. In order to adhesively bond the sealing member 54 to the casing 6, it is necessary to hold the sealing member 54 at an appropriate position inside a limited space corresponding to the free length of the sealing member 54. Moreover, for adhesion, it is necessary to push the sealing member 54 against the interior surface of the casing 6. In contrast, if light sealing is used as in the third embodiment, the required steps are less troublesome than those of adhesive bonding, though it is necessary to pay sufficient attention to the angle of contact when the conveying belt 5 and the casing 6 are assembled.

Similarly to the structure illustrated in FIG. 10, light sealing may be applied to a case where a single sealer is provided as in the second embodiment. That is, the single sealing member 54 of the foregoing embodiment may be replaced with a single partitioning member that is not adhesively bonded to the interior surface of the casing 6.

Figure 11:
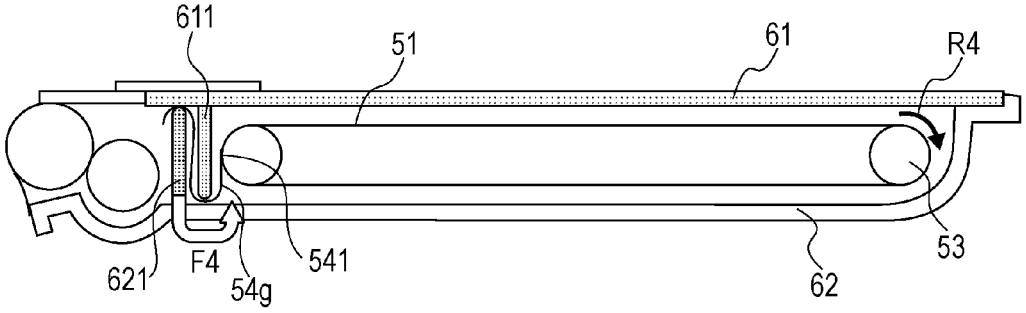
FIG. 11 is a schematic cross-sectional view of the structure of a development unit according to a variation example of the third embodiment.
Figure 12:
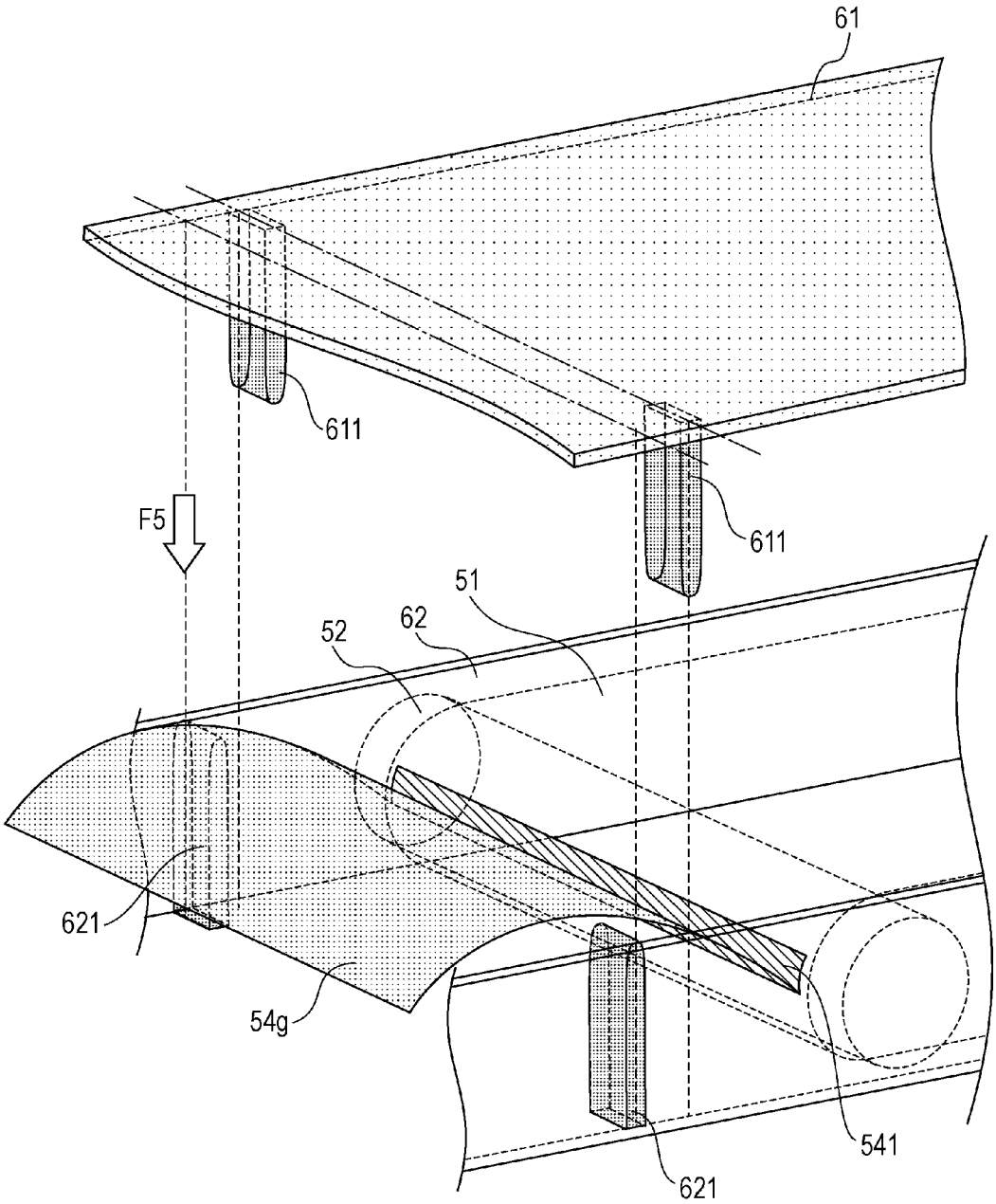
FIG. 12 is a schematic perspective view of the structure of the development unit according to the variation example of the third embodiment.

FIG. 11 is a schematic cross-sectional view of the development unit D in a case where a single partitioning member is provided for light sealing (partitioning). FIG. 12 is a schematic perspective view of said case. More specifically, FIG. 12 is a schematic perspective view of a state in which the top cover 61 is positioned apart from the casing body 62 and the conveying belt 5 (before the assembly process of the development unit D).

A partitioning member 54*g* is a flexible PET sheet that has a thickness of 50 μm. One end of the partitioning member 54*g*, specifically, a joined portion 541, is integrally joined to the conveying sheet 51. The other end of the partitioning member 54*g* is a free end.

A pushing portion 611 is a columnar member for sandwiching the partitioning member 54*g*. The base end of the pushing portion 611 is fixed to the top cover 61. The opposite end configured to face the fixed region has a gently rounded shape. A pushing portion 621 is a columnar counterpart whose base end is fixed to the casing body 62. The opposite end configured to face the fixed region has a gently rounded shape.

Regarding the arrangement of the joined portion 541 of the sealing member 54*g*, and the pushing portions 611 and 612 constituting a sandwiching portion, it is the second pushing portion 621 that is located at the nearest side in the depth direction. The second one in the depth direction is the first pushing portion 611. The joined portion 541 is located at the farthest side in the depth direction among them. Regarding the positions in the axial direction, as the constituents of the second pushing portion 621, two columns are provided at the respective two ends in the axial direction, each along the interior surface of the casing body 62. Similarly, as the constituents of the first pushing portion 611, two columns are provided at the respective two ends in the axial direction. When the top cover 61 is on the casing body 62, the side of each of the two columns constituting the first pushing portion 611 is along the interior surface of the casing body 62. Both the first pushing portion 611 and the second pushing portion 621 have a predetermined width in the axial direction and are designed to overlap with the partitioning member 54*g* in the axial direction.

Next, with reference to FIG. 12, the assembly process of the development unit D will now be explained. Before the development unit D is assembled, the joined portion 541 of the partitioning member 54*g* has been joined to the conveying belt 5. The conveying belt 5 with the partitioning member 54*g* is mounted into the casing body 62. In this step, as illustrated in FIG. 12, the free end of the partitioning member 54*g* is raised above the second pushing portion 621 in the thickness direction. After that, the top cover 61 and the casing body 62 are joined into one by mounting the top cover 61 in the direction indicated by an arrow F5 and by welding them at the edge surface together. In this step, the partitioning member 54*g* is pushed by the first pushing portion 611 and the second pushing portion 621. As a result, the partitioning member 54*g* becomes sandwiched by the pushing portion 611 and the casing body 62, and by the pushing portion 621 and the top cover 61. Therefore, as illustrated in FIG. 11, which shows an assembled state, the space formed by the top cover 61 and the casing body 62 becomes partitioned by the sealing member 54*g*.

The development unit D is thereafter attached to the image forming apparatus 100. Due to motive power transmission to the driving shaft 52, the conveying sheet 51 travels in a circulating manner in the direction indicated by the arrow R4. Because of sheet movement, the partitioning member 54*g* is drawn out in the direction indicated by the arrow R4, and the toner is supplied to the supply roller 3 and then to the development roller 1.

Figure 13:
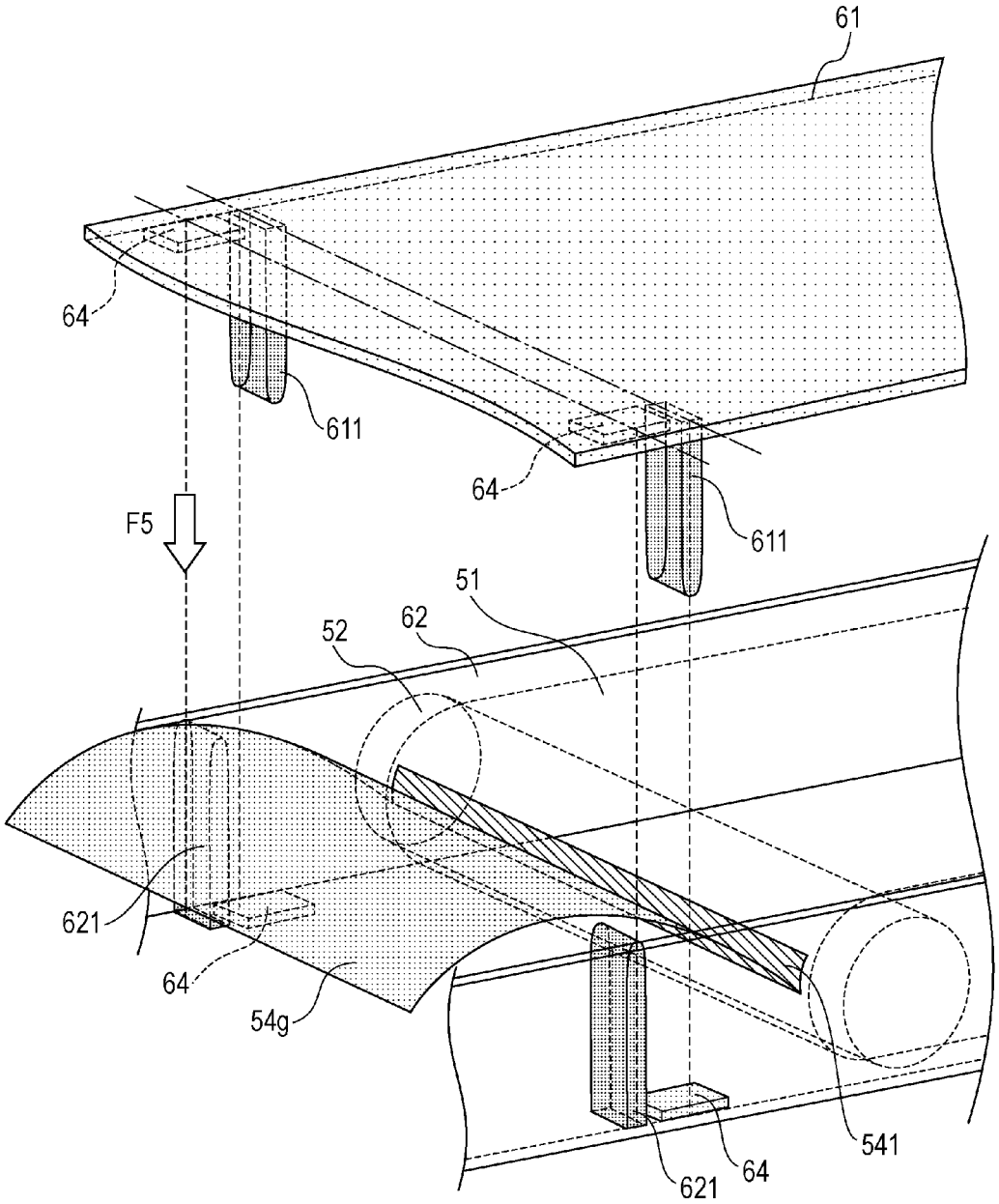
FIG. 13 is a schematic perspective view of the structure of a development unit according to a variation example of the third embodiment.

As illustrated in the schematic perspective diagram of FIG. 13, an elastic sealing pad 64 may be provided at each position where it is to be in contact with the pushing portion 611, 621 when the top cover 61 and the casing body 62 are welded together. These pads function to fill the gap between the partitioning member 54*g* and the casing 6, resulting in enhanced toner hermeticity.

Figure 14:
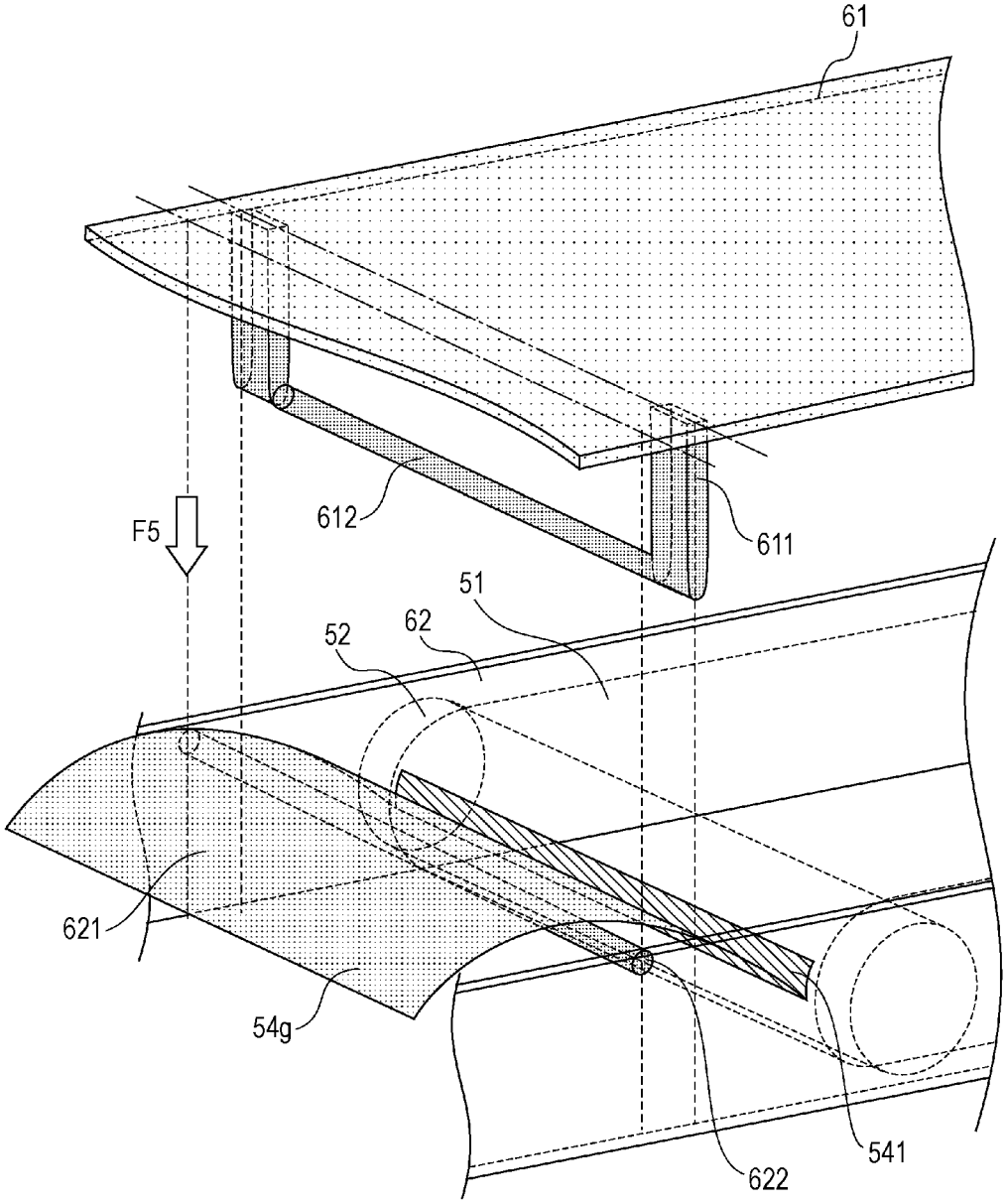
FIG. 14 is a schematic perspective view of the structure of a development unit according to a variation example of the third embodiment.

The members for pushing the partitioning member 54*g* may have a sandwiching structure extending continuously in the axial direction, for example, may have the structure of a first pushing portion 611 and a second pushing portion 621 illustrated in the schematic perspective diagram of FIG. 14. Since this structure reduces the distortion of the partitioning member 54*g*, toner hermeticity further improves. The first pushing portion 611 and the second pushing portion 621 constitute a sandwiching portion, and each of the contact surface of the first pushing portion 611 toward the casing body 62 and the contact surface of the second pushing portion 621 toward the top cover 61 has a gently rounded shape. Since this structure reduces the area size of contact of each of the first pushing portion 611 and the second pushing portion 621 with the partitioning member 54*g*, it is possible to reduce the torque required for breaking the seal.

Fourth Embodiment

In the first, second, and third embodiments, the partitioning member 54 that remains joined to the conveying belt 5 after breaking the seal is used for sealing the toner space, or for light sealing. However, the partitioning member may remain joined to the casing 6, instead of the conveying belt, after breaking the seal.

Figure 15:
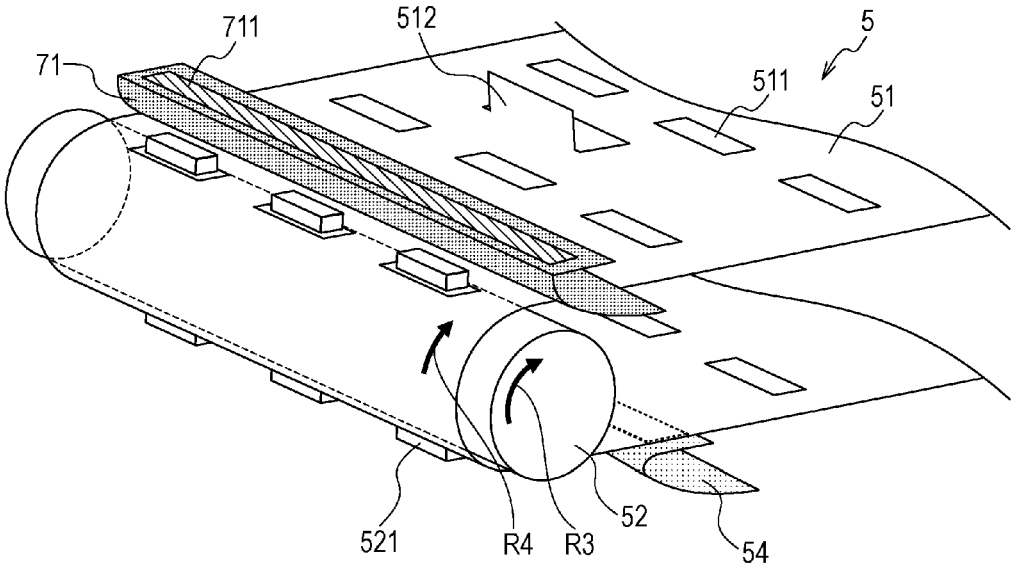
FIG. 15 is a schematic perspective view of the structure of a development unit according to a fourth embodiment.

For example, as illustrated in FIG. 15, a restriction sheet 71 that is made of a flexible sheet material may be used as the partitioning member. The restriction sheet 71 is a PET sheet that has a thickness of 100 μm. The restriction sheet 71 has a joined portion 711 at its one end. This end is joined to the top cover 61. The other end of the restriction sheet 71 is a free end that is in contact with the conveying sheet 51. The width of the restriction sheet 71 in the axial direction is greater than that of the conveying sheet 51 and is slightly less than the from-sidewall-to-sidewall interior width of the casing 6 in the axial direction.

Figure 16:
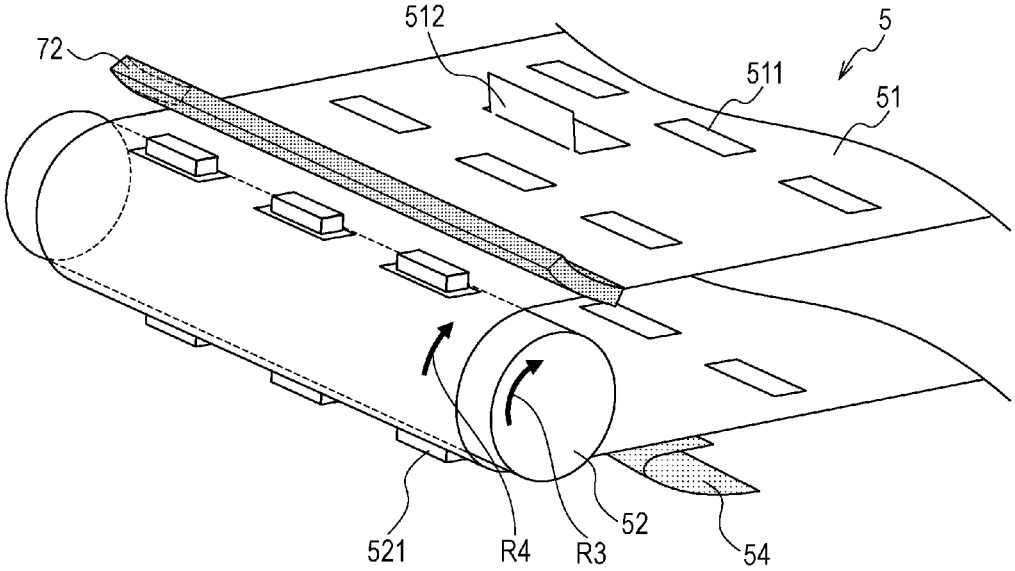
FIG. 16 is a schematic perspective view of the structure of a development unit according to a variation example of the fourth embodiment.

As illustrated in FIG. 16, a flexible restriction plate 72 may be used as the partitioning member. The restriction plate 72 is a flexible urethane rubber plate. At its one end, the restriction plate 72 has a joined portion that is not illustrated. This end is joined to the top cover 61. The other end of the restriction plate 72 is a free end. A corner at the free end of the restriction plate 72 is in contact with the conveying sheet 51.

Figure 17:
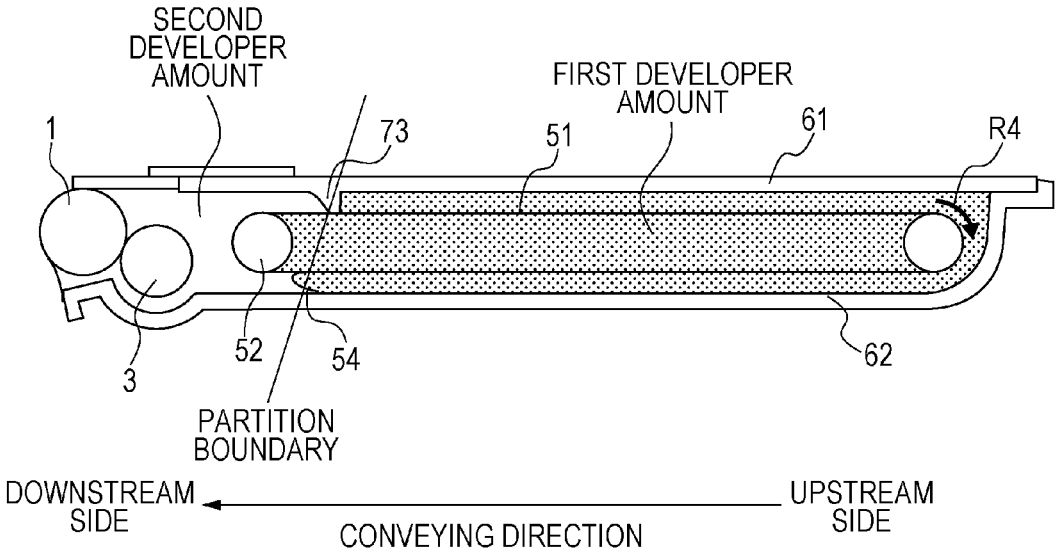
FIG. 17 is a schematic cross-sectional view of the structure of a development unit according to a variation example of the fourth embodiment.

Another modification example is illustrated in FIG. 17. As illustrated therein, the top cover 61 may have a restriction rib 73 that is a casing protrusion functioning as the partitioning member. The casing protrusion, that is, the restriction rib 73, is a part of the top cover 61 and is molded together with the other part of the top cover 61 by means of a cover-molding die that has a recess. In order to have a toner-sealing function, the restriction rib 73 extends continuously in the axial direction, and has size that is sufficient for contact with the conveying sheet 51 in the thickness direction. Since the restriction rib 73 is rigid, the conveying sheet 51 is deformed by the restriction rib 73.

In the description below, the restriction sheet 71, the restriction plate 72, and the restriction rib 73, which remain joined to the casing 6 after breaking the seal, are collectively referred to as circulation restriction member 7.

Preferably, the circulation restriction member 7 should be disposed downstream of the driving shaft 52 in the circulating direction, that is, integrally on the top cover 61. If the circulation restriction member 7 were disposed upstream of the driving shaft 52 in the circulating direction, that is, integrally on the casing body 62, it would be harder for the space formed by the conveying sheet 51 and the casing 6 to open during the operation of breaking the seal. Exceptionally, in such a case, some amount of toner might flow in through a clearance formed due to the deformation of the flexible restriction sheet, the flexible restriction plate, or the conveying sheet 51 by the conveying blades 512 of the conveying sheet 51 and the partitioning member 54. In addition, a toner is allowed to move to the inside/outside of the conveying belt 5 through the insertion slits 511. However, in comparison with a case where the partitioning member disposed upstream of the driving shaft 52 in the circulating direction is integrally joined to the conveying sheet 51, the amount of toner movement in the case described above would be far smaller. This is the reason why it is not preferable to dispose the circulation restriction member 7 upstream of the driving shaft 52 in the circulating direction.

Figure 18A:
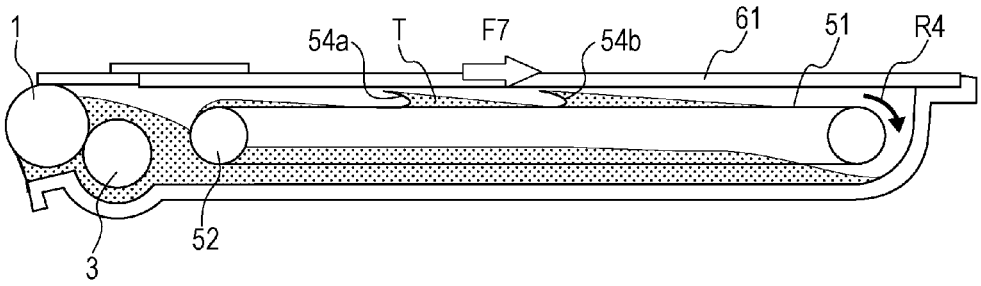
FIG. 18A is a schematic cross-sectional view of the structure of a development unit according to a variation example of the first embodiment.
Figure 18B:
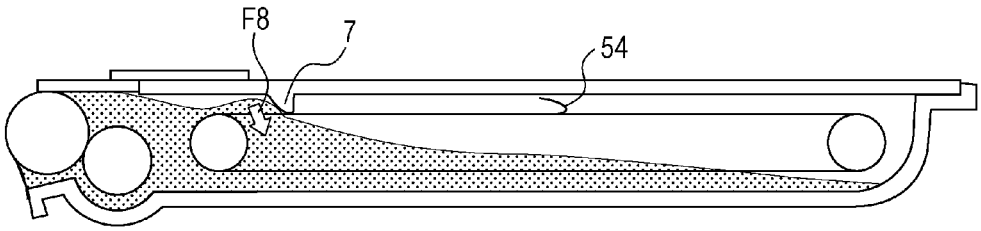
FIG. 18B is a schematic cross-sectional view of the structure of the development unit according to the fourth embodiment.

Moreover, disposing the circulation restriction member 7 downstream of the driving shaft 52 in the circulating direction improves the performance of toner supply to the development roller 1. In order to ensure stable toner supply to the development roller 1, it is better that a large amount of toner be present near the development roller 1. The void inside the casing 6 increases due to toner consumption as a result of repetitive image forming operation. In such a void-increased state, whether it is possible to form an image or not could depend on the position of the circulation restriction member 7. A case where the circulation restriction member 7 is not disposed downstream of the driving shaft 52 in the circulating direction is illustrated in the schematic cross-sectional diagram of FIG. 18A. Specifically, in the illustrated case, the toner that is on the conveying sheet 51 is conveyed in the direction indicated by an arrow F7, which is the circulating direction, without being blocked at all. In contrast, in a case where the circulation restriction member 7 is disposed downstream of the driving shaft 52 in the circulating direction, as illustrated in FIG. 18B, the circulation restriction member 7 blocks the toner that is on the conveying sheet 51 to restrict its circulation. Since the conveying sheet 51 has the insertion slits 511 at plural places, a toner is allowed to move to the inside/outside of the conveying belt 5 through the insertion slits 511. Therefore, the toner blocked by the circulation restriction member 7 drops through the insertion slit 511 in the direction indicated by an arrow F8. This produces a state in which there is a large amount of toner near the development roller 1, resulting in improved performance of toner supply to the development roller 1.

Preferably, the angle of contact of the circulation restriction member 7 with the conveying sheet 51 should be an obtuse angle in the circulating direction. If the angle of contact of the circulation restriction member 7 with the conveying sheet 51 were an acute angle in the circulating direction, the conveying blade 512 would get caught on the circulation restriction member 7. When the conveying blade 512 gets caught on the circulation restriction member 7, there is a risk that gears, the conveying blade 512, or the conveying sheet 51 might be damaged due to the high torque of the driving shaft 52. If a flexible member such as the restriction sheet 71 or the restriction plate 72 is used as the circulation restriction member 7, the restriction sheet 71 or the restriction plate 72 might be damaged.

Fifth Embodiment

In the first to fourth embodiments, the conveying belt 5 includes a single conveying sheet 51. However, the conveying belt may have a split-sheet structure made up of plural conveying sheets 51 in the axial direction. For example, as illustrated in the schematic perspective diagram of FIG. 19, two conveying sheets, specifically, a first conveying sheet 51*c* and a second conveying sheet 51*d*, may share and be supported by the driving shaft 52 and the supporting shaft 53.

Partitioning members may be provided respectively for these two conveying sheets. In the illustrated example, a first partitioning member 54*h* is provided for the first conveying sheet 51*c*, and a second partitioning member 54*i* is provided for the second conveying sheet 51*d* Preferably, the width of the first, second partitioning member 54*h*, 54*i* should be greater than the width of the first, second conveying sheet 51*c*, 51*d* in the axial direction, and the first partitioning member 54*h* and the second partitioning member 54*i* should overlap with each other in the axial direction. In addition, preferably, the joined portion 541*h* of the first partitioning member 54*h* on the first conveying sheet 51*c* and the joined portion 541*i* of the second partitioning member 54*i* on the second conveying sheet 51*d* should be at the same position in the circulating direction. The overlap region of the first partitioning member 54*h* and the second partitioning member 54*i* in the preferred structure described above makes toner entry through the gap between these two partitioning members harder.

Figure 19:
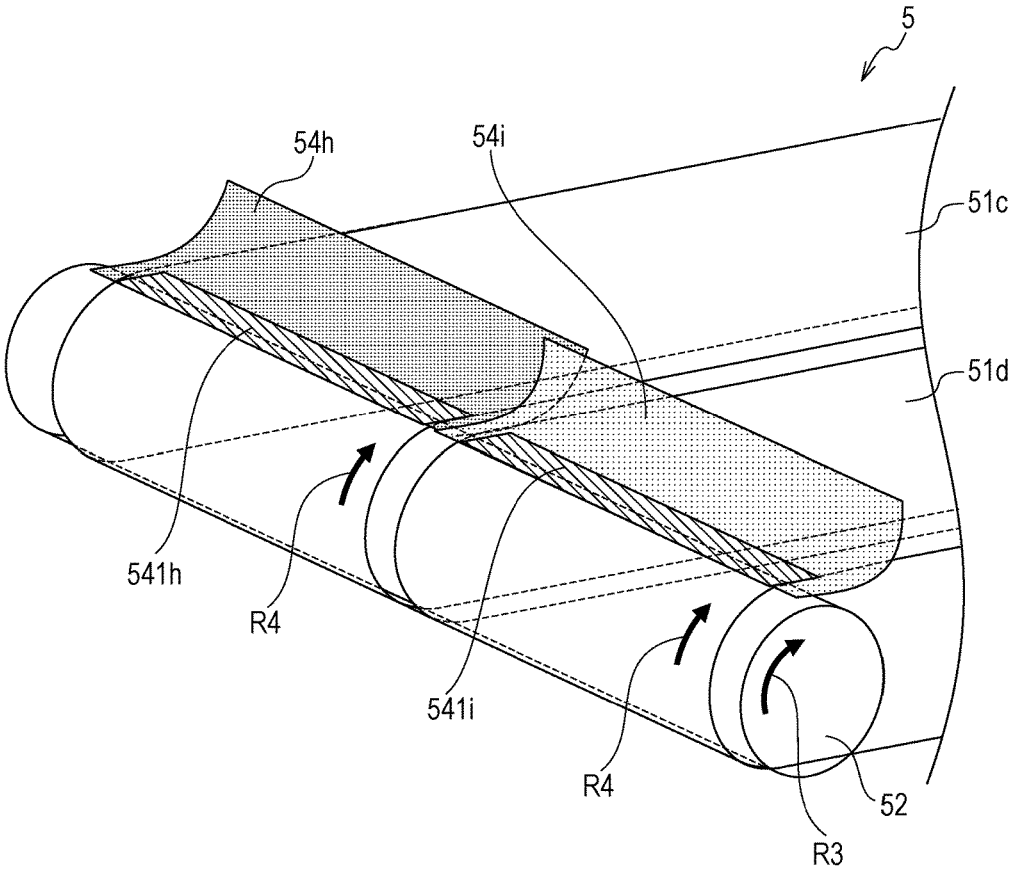
FIG. 19 is a schematic perspective view of the structure of a development unit according to a fifth embodiment.

Moreover, preferably, the phase of the conveying belt 5 should be adjusted in such a way that the position of the first, second joined portions 541*h*, 541*i* in the circulating direction when the developer container is new (when in mint condition) is overlapped on the driving shaft 52. If the first joined portion 541*h* and the second joined portion 541*i* were in alignment with each other at a position away from the driving shaft 52 in the circulating direction, the toner would go in through the gap between the two conveying sheets 51*c* and 51*d*. In contrast, by sealing the gap between the two conveying sheets 51*c* and 51*d* by aligning the two partitioning members 54*h* and 54*i* with each other on the driving shaft 52 as illustrated in FIG. 19, it is possible to significantly reduce the entry of the toner.

Figure 20:
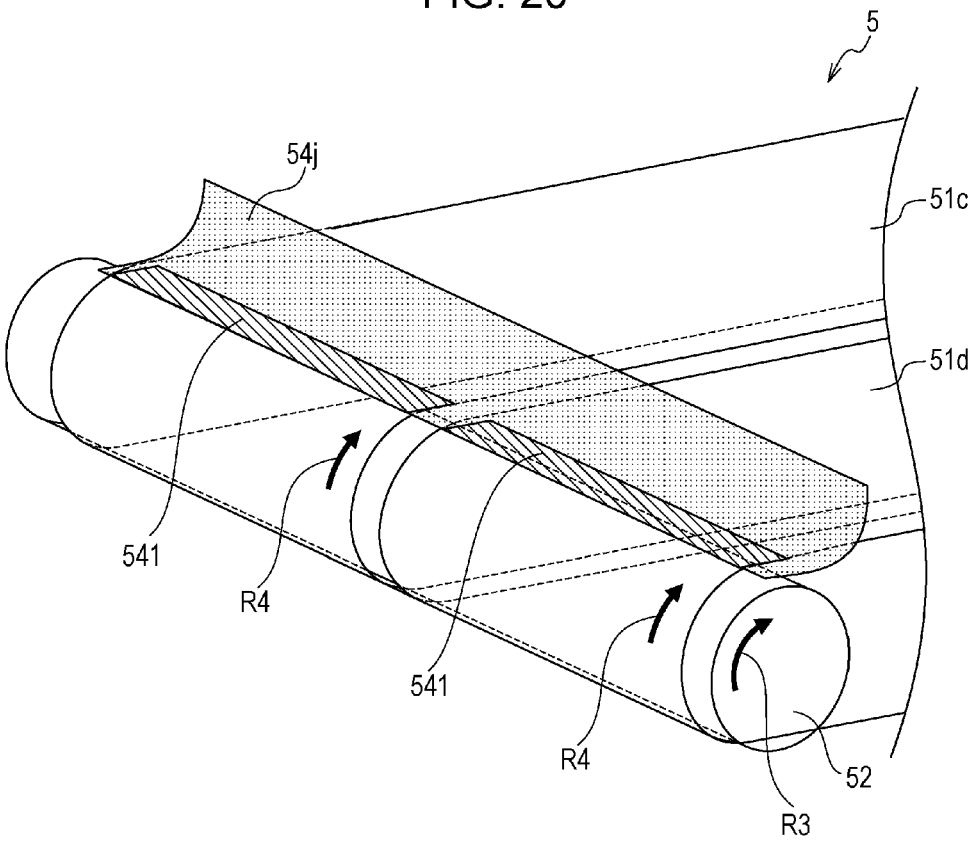
FIG. 20 is a schematic perspective view of the structure of a development unit according to a variation example of the fifth embodiment.

A modified structure is illustrated in the schematic perspective diagram of FIG. 20. As illustrated therein, a single partitioning member 54*j* may be joined to the two conveying sheets 51*c* and 51*d* in such a way as to traverse the gap therebetween. This structure further reduces toner entry through the gap between the two conveying sheets 51*c* and 51*d*.

Figure 21:
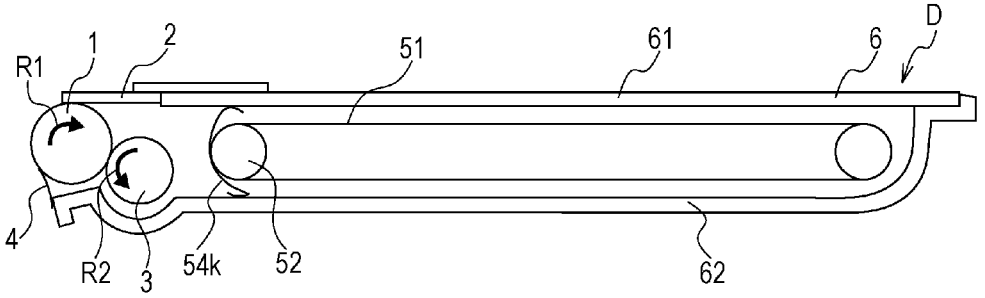
FIG. 21 is a schematic cross-sectional view of the structure of a development unit according to a variation example of the fifth embodiment.
Figure 22:
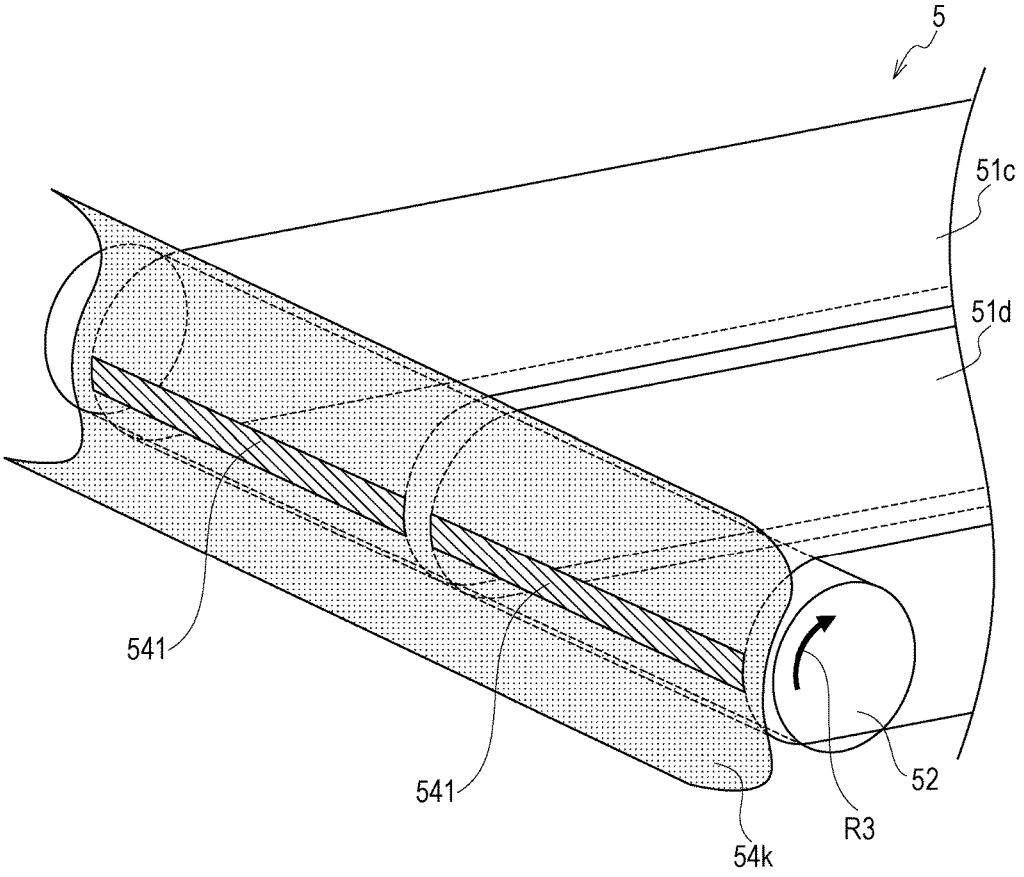
FIG. 22 is a schematic perspective view of the structure of the development unit according to the variation example of the fifth embodiment.

Another modified structure is illustrated in the schematic cross-sectional diagram of FIG. 21 and the schematic perspective diagram of FIG. 22. As illustrated therein, a single partitioning member 54*k* may be provided for light sealing similarly to the structure illustrated in FIG. 7. Specifically, the center of the partitioning member 54*k* may be fixed to the conveying sheets 51*c* and 51*d* to configure each of the two ends of the sealing member 54*k* in the circulating direction as a free end, and the respective free ends may be on the top cover 61 and the casing body 62.

The structure described earlier in any of the first to fourth embodiments may be applied to the structure of the fifth embodiment, in which the conveying belt has a split-sheet structure made up of plural conveying sheets 51 in the axial direction. For example, the sealing member 54 may be adhesively bonded to the casing 6 when in mint condition, or may have a light-sealing structure. As the sealing member, for example, the circulation restriction member 7 described in the fourth embodiment may be used.

Sixth Embodiment

In the foregoing embodiments, a development unit that is an example of a development apparatus is described. However, the scope of application of the technique disclosed herein is not limited thereto. The described technique may be applied to a developer container that contains developer, for example, a toner replenishment bottle. Such an application may be embodied by providing, in or on a developer container that has a mouth, a partitioning member for sealing the mouth. The described technique may be applied to, instead of a developer container, a process cartridge that has a photosensitive drum that is an example of an image bearing member. Specifically, a developer chamber and a toner chamber inside a process cartridge may be in communication with each other via an opening, and a partitioning portion may be provided for sealing the opening. The described technique may be applied to a structure of, by moving a partitioning portion, unsealing an opening to supply a toner contained in a toner chamber to a development roller that is an example of a developer bearing member in a developer chamber, thereby developing an image on a photosensitive drum that is an example of an image bearing member.

The developer container and/or the process cartridge may be detachably attached to the image forming apparatus. For example, if the developer container is detachably attached to the image forming apparatus, the body of the apparatus means the portion excluding the developer container. Similarly, if the process cartridge is detachably attached to the image forming apparatus, the body of the apparatus means the portion excluding the process cartridge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-078266 filed Apr. 8, 2016 and No. 2017-024417 filed Feb. 13, 2017, which are hereby incorporated by reference herein in their entirety.

What is claimed is:

1. A developer container, comprising:

a casing that contains developer; and a belt-shaped conveying member configured to convey the developer and including a partitioning portion, the partitioning portion being a partition for the developer contained in the casing with respect to a conveying direction in which the developer is conveyed, wherein the partitioning portion is in contact with an interior surface of the casing when the developer container is new and extends in a direction intersecting with the conveying direction in which the developer is conveyed, wherein, when the developer container is new, a first developer amount which is an amount of the developer contained at an upstream side that is upstream of the partitioning portion in the conveying direction, is larger than a second developer amount which is an amount of the developer contained at a downstream side that is downstream of the partitioning portion in the conveying direction, the partitioning portion (i) being moved to downstream side in the conveying direction together with the conveying member and moved relative to the casing or (ii) being joined to the casing and moved relative to the conveying member when the conveying member moves in circulating direction.

2. The developer container according to claim 1, wherein the partitioning portion is in contact with an upper interior surface and a lower interior surface of the casing in a gravity direction.

3. The developer container according to claim 1, wherein the partitioning portion includes a first partitioning portion and a second partitioning portion; and wherein, when the developer container is new, the first partitioning portion and the second partitioning portion are in contact with respective interior surface of the casing.

4. The developer container according to claim 1, wherein the casing has an opening; and wherein the partitioning portion is disposed in such a way as to cover the opening.

5. The developer container according to claim 1, wherein the casing includes a circulation restriction member configured to restrict circulation of the developer; and wherein the circulation restriction member is the partition for the developer contained in the casing with respect to the conveying direction.

6. The developer container according to claim 1, wherein the second developer amount is not greater than one fiftieth of the first developer amount.

7. The developer container according to claim 1, wherein the conveying member has a hole; and wherein a length of the hole in a longitudinal direction is less than a length of the partitioning portion in the longitudinal direction.

8. The developer container according to claim 1, wherein the casing includes a sandwiching portion configured to sandwich the partitioning portion.

9. A development apparatus, comprising:

a developer bearing member configured to bear developer; and the developer container according to claim 1.

10. A process cartridge, comprising:

an image bearing member configured to bear an image to be developed by means of developer; and the developer container according to claim 1.

11. An image forming apparatus configured to form an image on a recording medium, comprising:

the developer container according to claim 1.

12. A developer container, comprising:

a casing that contains developer; and a belt-shaped conveying member configured to convey the developer and including a partitioning portion, the partitioning portion being a partition for the developer contained in the casing with respect to a conveying direction in which the developer is conveyed, wherein the partitioning portion is in contact with an interior surface of the casing when the developer container is new and extends in a direction intersecting with the conveying direction in which the developer is conveyed, wherein, when the developer container is new, a first developer amount which is an amount of the developer contained at an upstream side that is upstream of the partitioning portion in the conveying direction, is larger than a second developer amount which is an amount of the developer contained at a downstream side that is downstream of the partitioning portion in the conveying direction, and wherein the second developer amount is 0 g or greater, but not greater than 5 g.

13. A developer container, comprising:

a casing that contains developer; and a belt-shaped conveying member configured to convey the developer and including a partitioning portion, the partitioning portion being a partition for the developer contained in the casing with respect to a conveying direction in which the developer is conveyed, wherein the partitioning portion is in contact with an interior surface of the casing when the developer container is new and extends in a direction intersecting with the conveying direction in which the developer is conveyed, wherein, when the developer container is new, a first developer amount which is an amount of the developer contained at an upstream side that is upstream of the partitioning portion in the conveying direction, is larger than a second developer amount which is an amount of the developer contained at a downstream side that is downstream of the partitioning portion in the conveying direction, wherein the conveying member includes a conveying sheet and a belt protrusion protruding from the conveying sheet, and wherein a length of the belt protrusion from the conveying sheet to a free end of the belt protrusion is less than a length of the partitioning portion from a fixed portion of the partitioning portion to a free end of the partitioning portion.

* * * * *